US006893280B2

(12) United States Patent
Thompson et al.

(10) Patent No.: US 6,893,280 B2
(45) Date of Patent: May 17, 2005

(54) TOGGLE TYPE TELECOMMUNICATIONS TERMINAL BLOCKS

(75) Inventors: Roy Keller Thompson, Apex, NC (US); Julian Mullaney, Raleigh, NC (US); Alan Carrico, Raleigh, NC (US); Eric Alston, Fuquay Varina, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/426,892

(22) Filed: Apr. 30, 2003

(65) Prior Publication Data

US 2004/0219815 A1 Nov. 4, 2004

(51) Int. Cl.[7] ..... H01R 13/52
(52) U.S. Cl. ..... 439/276; 439/409
(58) Field of Search ..... 439/276, 936, 439/519, 409, 410

(56) References Cited

U.S. PATENT DOCUMENTS

| | | | | |
|---|---|---|---|---|
| 3,466,254 A | | 9/1969 | Deasy | 200/11 |
| 3,467,792 A | | 9/1969 | Allison | 200/11 |
| 4,115,665 A | | 9/1978 | Giacoppo et al. | 179/98 |
| 4,276,562 A | | 6/1981 | Stewart et al. | 358/86 |
| 4,494,138 A | | 1/1985 | Shimp | 358/86 |
| 4,559,420 A | | 12/1985 | Yamada | 200/6 A |
| 4,578,702 A | | 3/1986 | Campbell, III | 358/86 |
| 4,634,207 A | | 1/1987 | Debbaut | 339/116 C |
| 4,640,995 A | | 2/1987 | Naaijer | 200/11 |
| 4,686,667 A | | 8/1987 | Ohnsorge | 370/4 |
| 4,864,725 A | | 9/1989 | Debbaut | 29/871 |
| 4,885,747 A | | 12/1989 | Foglia | 370/123 |
| 4,930,120 A | | 5/1990 | Baxter et al. | 370/73 |
| 4,935,924 A | | 6/1990 | Baxter | 370/73 |
| 4,959,554 A | | 9/1990 | Underwood, IV et al. | 307/38 |
| 5,058,198 A | | 10/1991 | Rocci et al. | 455/3 |
| 5,093,718 A | | 3/1992 | Hoarty et al. | 358/84 |
| 5,130,793 A | | 7/1992 | Bordry et al. | 358/86 |
| 5,187,733 A | | 2/1993 | Beffel et al. | 379/10 |
| 5,281,163 A | * | 1/1994 | Knox et al. | 439/404 |
| 5,359,654 A | | 10/1994 | Jensen et al. | 379/397 |
| 5,363,432 A | | 11/1994 | Martin et al. | 379/90 |
| 5,423,694 A | | 6/1995 | Jensen et al. | 439/417 |
| 5,481,073 A | | 1/1996 | Singer et al. | 200/1 R |
| 5,505,901 A | | 4/1996 | Harney et al. | 348/10 |
| 5,557,250 A | | 9/1996 | Debbaut et al. | 338/21 |
| 5,583,863 A | | 12/1996 | Darr, Jr. et al. | 370/397 |
| 5,583,864 A | | 12/1996 | Lightfoot et al. | 370/396 |
| 5,588,869 A | | 12/1996 | Jensen et al. | 439/417 |
| 5,681,182 A | | 10/1997 | Reichle | 439/417 |

(Continued)

FOREIGN PATENT DOCUMENTS

| | | |
|---|---|---|
| WO | 94/18722 | 8/1994 |
| WO | 99/04454 | 1/1999 |

OTHER PUBLICATIONS

Notification of Transmittal of the International Search Report and the Written Opinion of the International Searching Authority, or the Declaration, for PCT/US2004/010553.

*Primary Examiner*—Ross Gushi
(74) *Attorney, Agent, or Firm*—Myers Bigel Sibley & Sajovec

(57) ABSTRACT

Telecommunications terminal blocks for making and breaking connections with a telecommunications conductor include a unitary base that defines a body cavity having a hinge member at an end thereof. In other embodiments a base includes a hinge member on an external surface thereof. First and second connectors are mounted in the base and extend into the body cavity. A toggle member is rotatably connected to the base at the hinge member. The toggle member has first and second conductor receiving openings therein and first and second conductor passages extending from the respective openings past respective ones of the connectors. An environmental sealant material is positioned in the body cavity.

35 Claims, 16 Drawing Sheets

U.S. PATENT DOCUMENTS 5,704,797 A 1/1998 Meyerhoefer et al. ..... 439/188
5,729,370 A 3/1998 Bernstein et al. ..... 359/118
5,785,548 A 7/1998 Capper et al. ..... 439/409
5,859,895 A 1/1999 Pomp et al. ..... 379/29
5,863,215 A 1/1999 Debbaut et al. ..... 439/412
5,911,598 A * 6/1999 Pawlenko ..... 439/521
6,028,928 A 2/2000 Mullaney et al. ..... 379/399
6,031,300 A 2/2000 Moran ..... 307/119
6,093,050 A 7/2000 Baum et al. ..... 439/412
6,102,731 A 8/2000 Daoud ..... 439/409
6,254,421 B1 7/2001 Denovich et al. ..... 439/409
6,302,723 B1 10/2001 Baum et al. ..... 439/412

* cited by examiner

TOGGLE TYPE TELECOMMUNICATIONS TERMINAL BLOCKS

BACKGROUND OF THE INVENTION

The present invention relates to electrical termination devices and, more particularly, to telecommunications terminal blocks.

Terminal blocks are typically used by telecommunications companies to connect connector wires of a multi-core cable to service wires that extend to customer residences or places of business. Such terminal blocks are typically located outdoors and may, thus, be exposed to environmental conditions, such as rain, snow, sleet, ice, temperature fluctuations, dirt, insect infestation and similar conditions that may adversely affect the electrical connections between the service wires and the electrical connectors. Thus, some form of sealant material may be provided in such terminal blocks.

Terminal blocks connecting telecommunications wire pairs, typically referred to as "tip" and "ring" lines, may be located at a variety of points on the telecommunications wiring network, including cross-connect panels, hubs, pedestals, network interface devices (NIDs) and the like. It is generally desirable to use a re-enterable terminal as, in use, a terminal block may be used multiple times to make and break electrical connections as the service provided to particular customer locations may change over time. As such, the terminal blocks may be subjected to frequent use and/or abuse over time, which may degrade the quality of the resulting electrical connections, the environmental protection provided to the connections and/or breakage of the terminal blocks, which typically include plastic components. Furthermore, various known terminal blocks may be subjected to unintentional opening of the terminal block and breaking of the electrical connection as a result of wire installation work or the like being performed on adjacent terminal blocks in environments such as a cross-connect.

SUMMARY OF THE INVENTION

Embodiments of the present invention include telecommunications terminal blocks for making and breaking connections with a telecommunications conductor. A unitary base defines a body cavity. The base includes a hinge member at an end thereof. First and second connectors are mounted in the base and extend into the body cavity. A toggle member is rotatably connected to the base at the hinge member. The toggle member has first and second conductor receiving openings therein and first and second conductor passages extending from the respective openings past respective ones of the connectors. An environmental sealant material is positioned in the body cavity.

In other embodiments of the present invention, the terminal blocks include a latching member having a first state allowing rotation of the toggle member to a conductor receiving position and a second state locking the toggle member in a conductor terminating position in which a conductor in the first or second conductor passage is electrically connected to a respective one of the first or second connector. A release member may be coupled to at least one of the base and the toggle member that is configured to allow movement of the latching member from the second state to the first state. The release member may be positioned adjacent the end of the base having the hinge member so that conductors extending from the openings do not pass adjacent the release member. The latching member may include a cross member on the toggle member positioned to contact a lead edge of a stop arm on the base in the second state of the latching member and to bypass the lead edge in the first state. The release member may include a lever arm on the toggle member coupled to the cross member having a rest position in which the latching member is in the second state and a flexed position in which the latching member is in the first state.

In further embodiments of the present invention, the toggle member is a removable toggle member and the toggle member includes a retention member configured to limit rotational movement of the toggle member beyond the conductor receiving position. The retention member may be configured to require a first force to rotate the toggle member beyond the conductor member to remove the toggle member from the base and a second force, lower than the first force, to install the toggle member in the base for rotational movement between the conductor receiving position and the conductor terminating position. The base may include a receiving opening in the end thereof having the hinge member through which a portion of the toggle member moves during rotational movement of the toggle member, the receiving opening having an associated width. In such embodiments, the toggle member may have a width in the portion thereof moving through the receiving opening less than the width of the receiving opening and the retention member may be an increased width portion of the toggle member positioned to contact the base at the receiving opening when the toggle is rotated past the conductor receiving position. The increased width portion of the toggle member may extend at an angle that provides a greater contact area with the base when the toggle member is rotated from the conductor terminating position past the conductor receiving position than when the toggle member is installed in the base.

In other embodiments of the present invention, the hinge member has a bearing contact surface of at least about 90 degrees. The bearing contact surface may be less than about 180 degrees. The toggle member may be a softer material than the base and portions of the toggle member and the base subject to forces when the toggle member is rotationally moved may be sized so that the toggle member will fail before the base on repeated use.

In further embodiments of the present invention, the environmental sealant is a silicone gel. The body cavity with the connectors mounted in the base may be devoid of openings up to at least an environmental sealant material fill level and the environmental sealant material may be a silicone gel that is placed in the body cavity in a liquid form.

In other embodiments of the present invention, the terminal block includes a visible circuit marker removably coupled to the terminal block to limit movement of the toggle member from the conductor terminating position to the conductor receiving position. The circuit marker may be coupled to the release member to limit movement of the release member.

In further embodiments of the present invention, the base defines a plurality of body cavities with respective connectors extending therein. A plurality of toggle members are positioned adjacent respective ones of the body cavities. The connectors may include an insulation displacing connector on a first end thereof at least partly in the body cavity and a second connection region on an opposite end thereof extending from the base.

In other embodiments of the present invention, cross-connect assemblies are provided including a plurality of the terminal blocks of the present invention and a plurality of wires, respective ones of which are connected to ones of the second connection regions. A potting compound may be located around the second connection regions to provide environmental sealing of the connections thereto. The mounting member may be a frame and the base may include an attachment member configured to couple the terminal block to the frame, for example, using a bolt. In other embodiments, the mounting member is a panel having a chamber on a bottom side thereof that receives the plurality of wires and a plurality of openings on a top side thereof configured to receive the terminal blocks. The openings are in communication with the chamber and a potting compound may be provided in the chamber for environmental protection.

In further embodiments of the present invention, telecommunications terminal blocks for making and breaking connections with a telecommunications conductor are provided. The terminal blocks include a base defining a body cavity. The base includes a hinge member on an external surface of the base at an end thereof. First and second connectors are mounted in the base and extend into the body cavity. A toggle member is rotatably connected to the base at the hinge member. The toggle member has first and second conductor receiving openings therein and first and second conductor passages extending from the respective openings past respective ones of the connectors. An environmental sealant material is positioned in the body cavity and at least partially surrounds the first and second connector.

In other embodiments of the present invention, telecommunications terminal blocks for making and breaking connections with a telecommunications conductor include a base defining a body cavity. The base includes a hinge member at an end thereof. First and second connectors are mounted in the base and extend into the body cavity. A toggle member is rotatably connected to the base at the hinge member. The toggle member has first and second conductor receiving openings therein and first and second conductor passages extending from the respective openings past respective ones of the connectors toward the hinge member. An environmental sealant material is positioned in the body cavity and at least partially surrounds the first and second connector. A latching member is provided having a first state allowing rotation of the toggle member to a conductor receiving position and a second state locking the toggle member in a conductor terminating position in which a conductor in the first or second conductor passage is electrically connected to a respective one of the first or second connector. A release member is coupled to at least one of the base and the toggle member that is configured to allow movement of the latching member from the second state to the first state. The release member is positioned adjacent the end of the base having the hinge member so that conductors extending from the openings do not pass adjacent the release member.

In further embodiments of the present invention, telecommunications terminal blocks for making and breaking connections with a telecommunications conductor include a base including a hinge member at an end thereof. At least one connector is mounted in the base. A toggle member is rotatably connected to the base at the hinge member. The toggle member has a conductor receiving opening therein and a conductor passage extending from the opening past the at least one connector toward the hinge member. A latching member has a first state allowing rotation of the toggle member to a conductor receiving position and a second state locking the toggle member in a conductor terminating position in which a conductor in the conductor passage is electrically connected to the connector. A release member is coupled to at least one of the base and the toggle member that is configured to allow movement of the latching member from the second state to the first state. The release member is positioned adjacent the end of the base having the hinge member so that a conductor extending from the opening does not pass adjacent the release member.

DETAILED DESCRIPTION

Figure 1A:
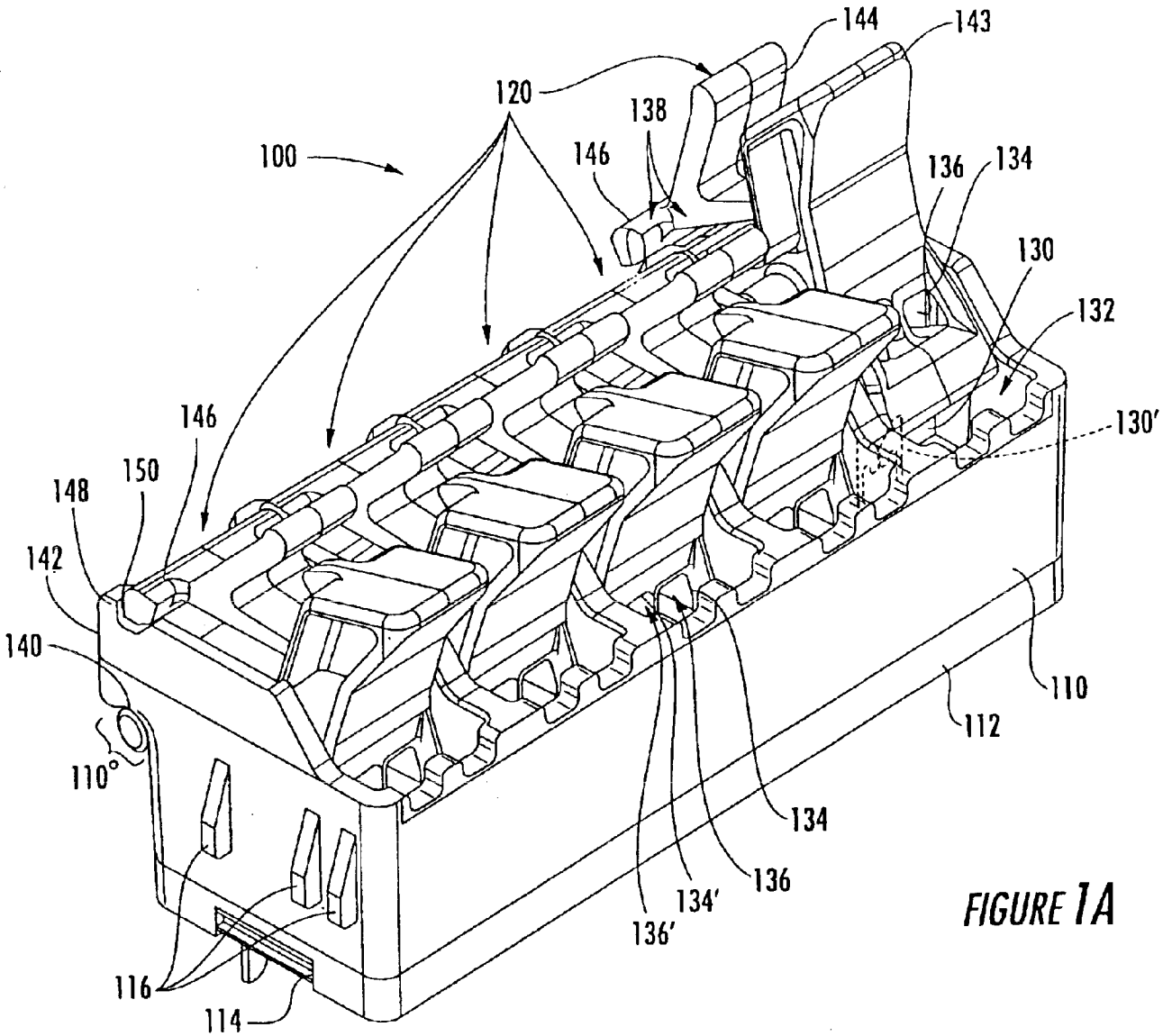
FIG. 1A is a perspective view of terminal blocks according to some embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1B:
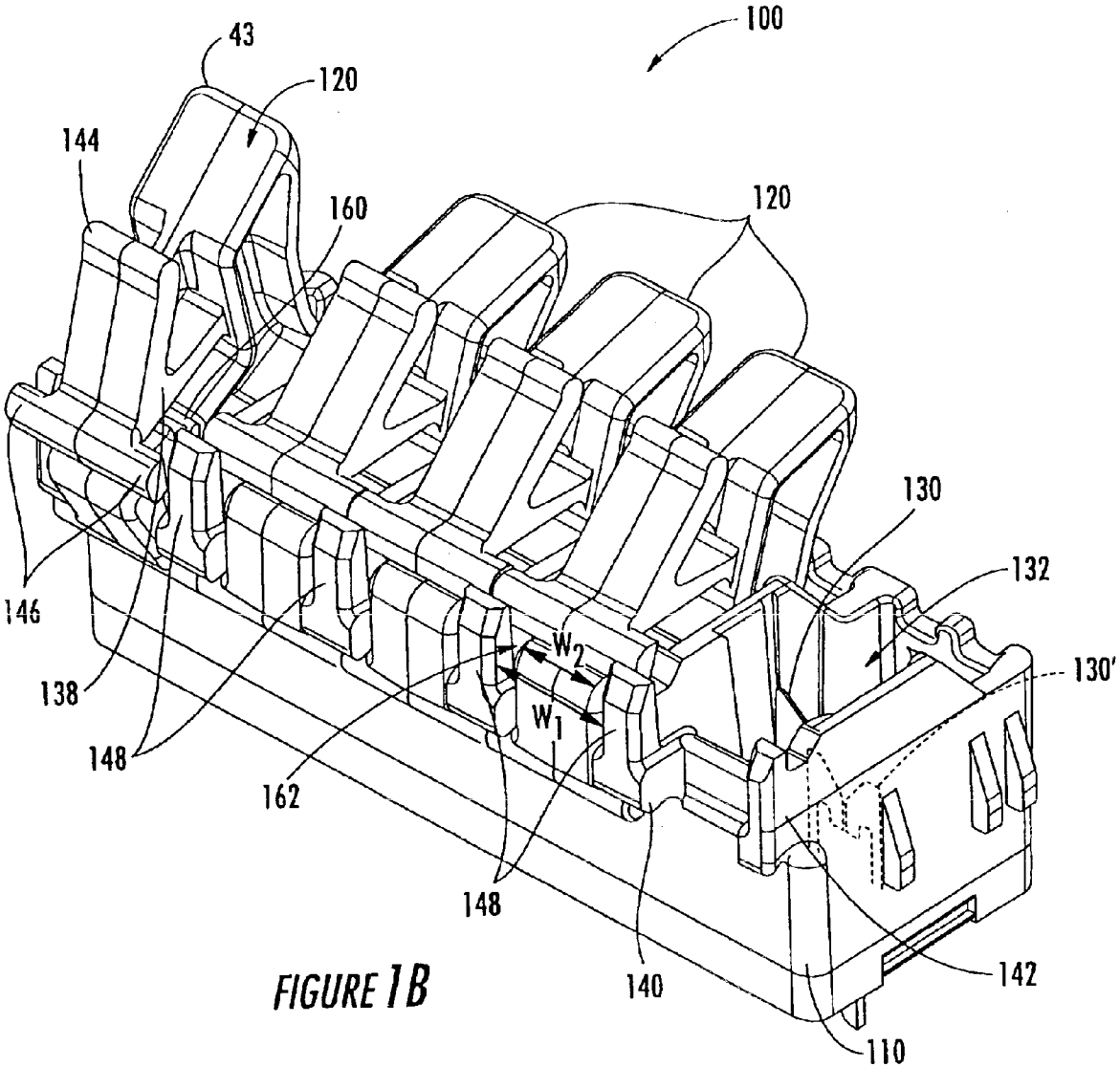
FIG. 1B is a further perspective view of the terminal blocks of FIG. 1A with one of the toggle members removed.

Embodiments of the present invention will now be described with reference to the various embodiments illustrated in FIGS. 1–14. FIGS. 1A and 1B are perspective views of a five station telecommunications terminal block 100 for making and breaking connections with telecommunications conductors. It will be understood that while a five station unit is shown in FIGS. 1A and 1B, other configurations fall within the scope of the present invention including a single station module, an eight station module and the like.

As shown in FIGS. 1A and 1B, the terminal block 1100 includes a unitary base 110 and a number of toggle members 120, each of which is rotatably connected to the base 110 at an end thereof. The base 110 defines a plurality of body cavities 132 therein. First and second connectors 130, 130' are mounted in the base 110 for each body cavity 132 and extend into the body cavities 132. As illustrated by the "T" and "R" notations shown in FIG. 1A, the first and second connector 130, 130' in each station may be associated with respective "tip" and "ring" wires of a telephone connection. The toggle members 120 are connected to the base 1110 at a hinge member 140 shown as located on an external surface of the base 110.

The toggle members 120 are configured to receive a pair of telecommunications terminal conductors and make and break an electrical connection between the telecommunications conductors and the connectors 130, 130'. In particular, the toggle members 120 each have first and second conductor receiving openings 134, 134' in one end thereof. Respective first and second conductor passages 136, 136' extend from the openings 134, 134' past respective ones of the connectors 130, 130'.

An environmental sealant may be placed in the body cavities 132 to facilitate environmental protection of the connection between the telecommunication conductors and the connectors 130, 130'. The environmental sealant may be, for example, a gel such as those disclosed in U.S. Pat. Nos. 4,634,207 and 4,864,725, which are incorporated herein by reference as if set forth in their entirety. The use of silicone gel environmental sealants may be particularly beneficial where the electrical connections are made and broken on a repeating basis to provide for a re-entrable sealant system. Electrical connections to a bottom end of the connectors 130, 130' in the bottom chamber 112 of the base 110 need, in various embodiments, not be re-entrable and may be environmentally scaled by an environmental sealant such as a potting compound.

The toggle members 120, as illustrated in FIGS. 1A and 1B, further include a latching member 138. The latching member 138 provides for a latched closed position for each toggle member 120 in one state and a further state in which the toggle members 120 may be rotated for removal and insertion of conductors therein or removal of the toggle member from the base 110. Thus, referring to FIG. 1A, the four toggle members 120 on the left portion on the base 110 are each in the latched state locking the toggle members 120 in a conductor terminating position in which a conductor in the first or second conductor passage 136, 136' may be electrically connected to the respective one of the connectors 130, 130'. The toggle member 120 in the right-most position as illustrated in FIG. 1A is in a state allowing rotation of the toggle member 120 and shows the toggle member 120 rotated to a conductor receiving position in which conductors may be inserted through the openings 134, 134' into the passages 136, 136' in preparation for making an electrical connection with the connectors 130, 130'.

To facilitate operation of the latching member 138, the toggle member 120 further includes a release member 144 coupled to the toggle member 120 that is configured to allow movement of the latching member 138 from the latched state (also referred to herein as the second state) to the moveable state (also referred to herein as the first state). As shown in FIG. 1A and FIG. 1B, the release member 144 is a lever arm on the toggle member 120 coupled to the latching member 138. The latching member 138 includes a cross member 146 positioned to contact a lead edge 150 on adjacent stop arms 148 of the base 110 when the latching member 138 is in the latched state. The lever arm 144 may be flexed to allow the cross member 146 to by-pass the lead edge 150 so as to allow rotational movement of the toggle member 120 to the conductor receiving position. To facilitate flexing of the release member 144 so that the toggle member 120 may be rotated, the toggle member may, as illustrated in FIGS. 1A and 1B, further include a grip arm 143 allowing a user to pinch the grip arm 143 and release arm 144 toward each other and rotate the toggle member 120.

As shown in FIGS. 1A and 1B, the release member 144 is positioned adjacent an end 142 of the base having a hinge member and opposite the end having the conductor receiving openings 134, 134' so that conductors extending from the openings 134, 134' need not pass adjacent the release member 144. This configuration may reduce or prevent inadvertent opening of the toggle member 120 due to movement of wires in the vicinity of the toggle member 120.

As shown in FIG. 1A, the hinge member 140 at the end 142 of the base 110 includes a bearing contact surface of about 110°. In various embodiments of the present invention, the bearing contact surface is at least about 90° and, in further embodiments, the bearing contact surface is less than about 180°. Such configurations may facilitate proper retention of the toggle members 120 when used with a unitary base 110 while still facilitating removal and insertion of the toggle members 120 into the base 110 during initial assembly or to replace broken or damaged toggle members 120 during use.

Additional mounting features are illustrated for the embodiments in FIG. 1A. A plurality of mounting tabs 116 are positioned on longitudinal ends of the body 110 to act as stops when mounting the terminal block 100. The tabs 116 may also be used for alignment of the terminal block 100. A mounting slot 114 is also shown in FIG. 1A that is positioned to engage a snap mechanism in a podium or bracket to which the terminal block 100 is mounted. It will be understood that the terminal block 100 may be a free standing unit or may be provided with a variety of different known mechanical type connection means for mounting the terminal block 100 in a variety of different enclosures or other environments in which it is desired to make telecommunications conductor connections.

Referring now to FIG. 1B, further aspects of the embodiments of the terminal block 100 related to limiting the risk of inadvertent removal of toggle members 120 from the base 110 will now be further described. In particular, for the embodiments illustrated in FIG. 1B, the toggle member 120 includes in a retention member 160 configured to limit rotational movement of the toggle member 120 beyond the conductor receiving position. The retention member 160 is configured to require a lower amount of force to install a toggle member 120 in the base than to remove a toggle member 120 from the base 110 after it has been properly installed. The retention member 160 interacts mechanically with the base 110 in a manner which will now be further described. As shown in FIG. 1B, the base 110 includes a receiving opening 162 in the end having the hinge member 140. As seen in FIG. 1B, a number of openings 162 are provided but the explanation herein will be presented with reference to a single toggle member station, which explanation will be understood to apply to any number of toggle members included within a base 110.

A portion of the toggle member 120 moves through the receiving opening 162 during rotational movement of the toggle member 120. The receiving opening 162 has an associated width $w_1$ and the toggle member 120 has an associated width $w_2$ in the portion thereof moving through the receiving opening 162 that is less than the width $w_1$ of the receiving opening 162. However, the retention member 160 is an increased width portion of the toggle member 120 positioned to contact the base 110 at the receiving opening 162 when the toggle member 120 is rotated past the conductor receiving position (as shown by the left-most toggle member 120 in FIG. 1B).

Figure 2:
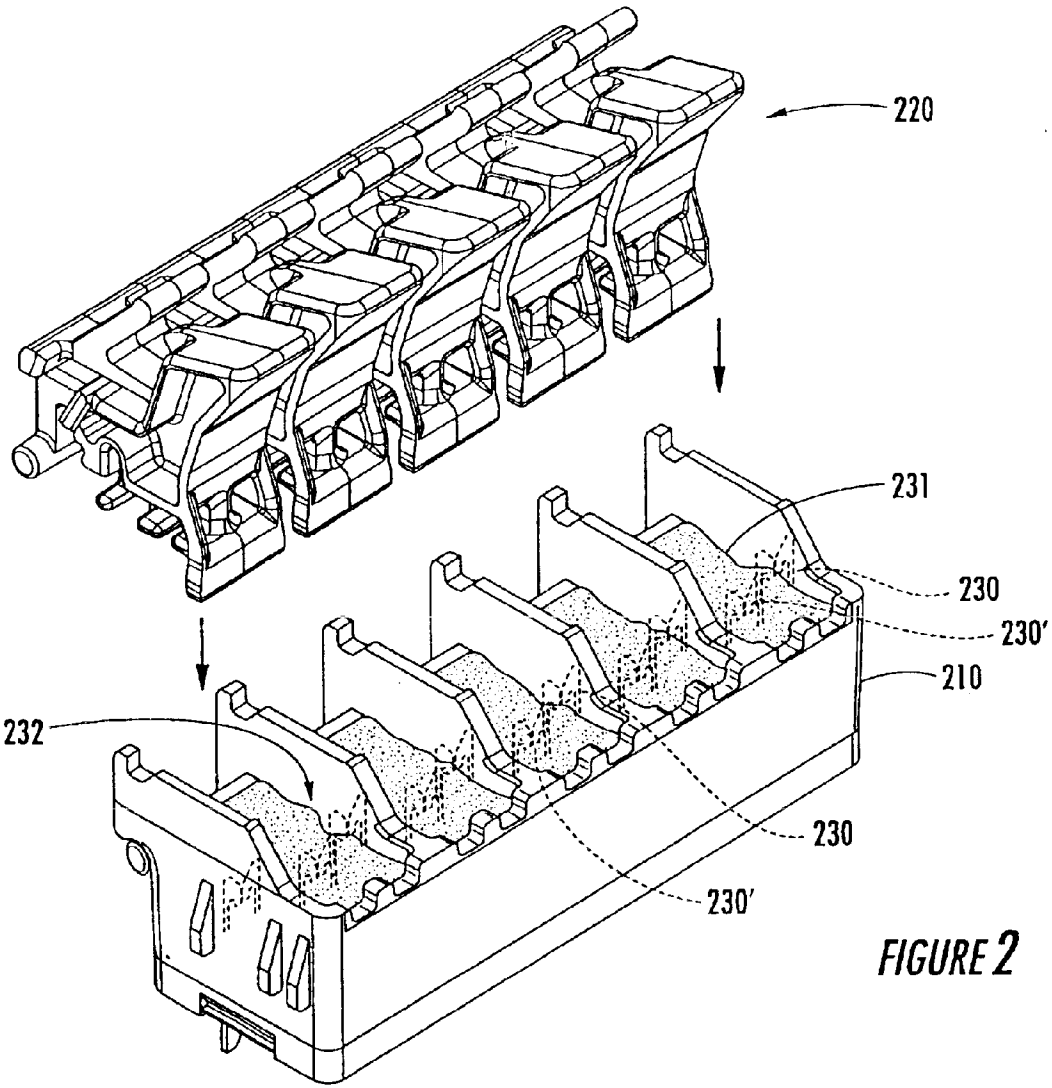
FIG. 2 is an exploded perspective view of terminal blocks according to some embodiments of the present invention.

Referring now to the exploded perspective view of FIG. 2, telecommunications terminal blocks 200 according to embodiments of the present invention will now be further described. Like numbered items (i.e., labeled with numbers having the same last two digits) in FIG. 2 generally correspond to those described previously with reference to FIGS. 1A and 1B. As shown in FIG. 2, the toggle members 220 are removed to more clearly show the body cavities 232 in the base member 210. As also shown in FIG. 2, each of the body cavities 232 includes first and second connectors 230, 230'. Various of the body cavities 232 are shown with an environmental sealant silicone gel 231 positioned therein. The body cavities 232, with the connectors 230, 230' mounted therein, are devoid of openings up to at least an environmental sealant material fill level. Thus, the silicone gel 231 may be placed in the body cavities 232 in a liquid form and allowed to set around the connectors 230, 230' prior to insertion of the toggle members 220 to facilitate providing an effective environmental seal for connections to the connectors 230, 230'. The environmental sealant fill level is illustrated by the level of the gel 231 in various of the body cavities 232 as shown in FIG. 2.

Figure 3A:
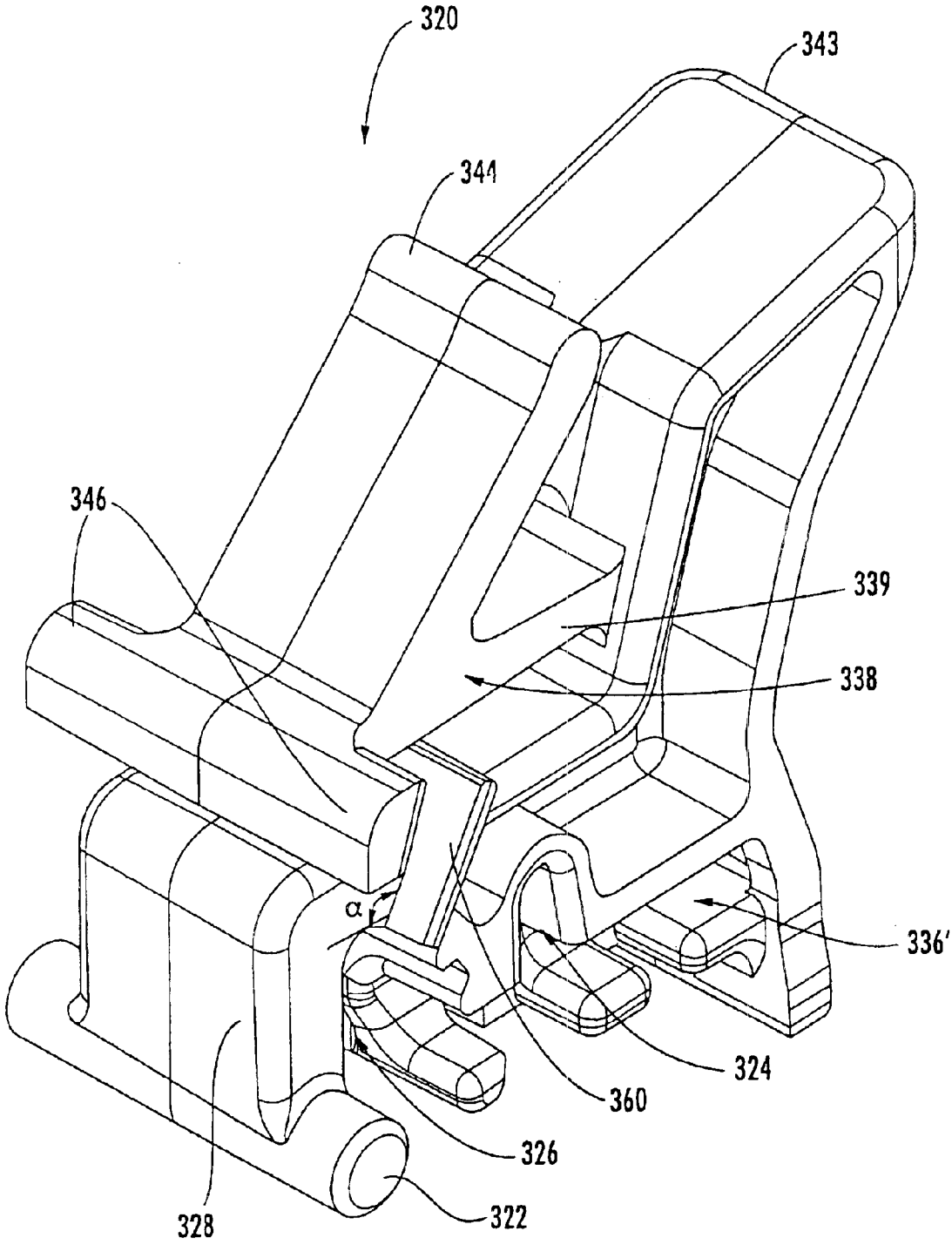
FIG. 3A is a perspective view of a toggle member according to some embodiments of the present invention.
Figure 3B:
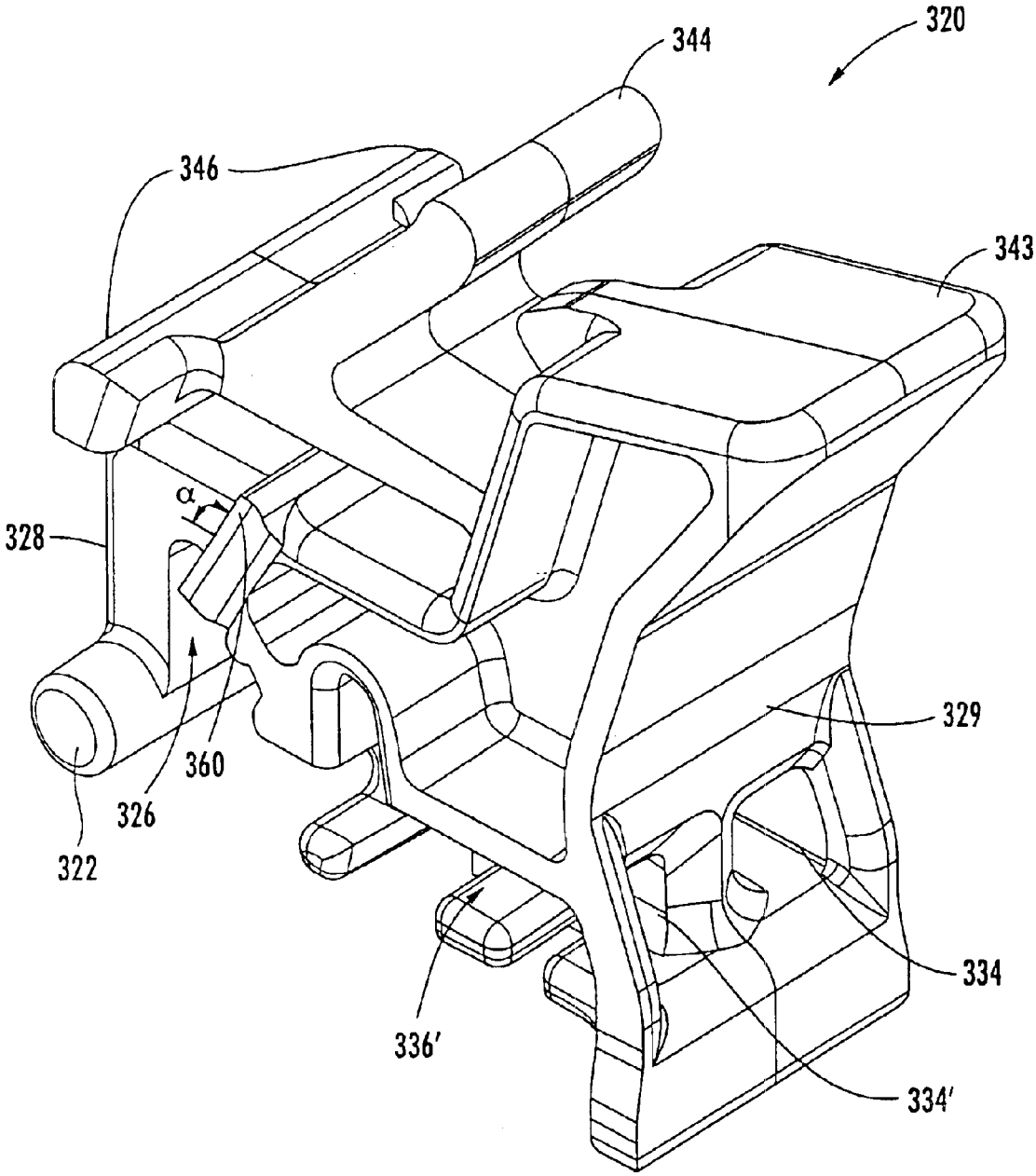
FIG. 3B is a second perspective view of the toggle member of FIG. 3A.

A toggle member 320 according some embodiments of the present invention will now be further described with reference to the prospective view illustrations of FIGS. 3A and 3B. As shown in FIGS. 3A and 3B, the toggle member 320 includes a latching member 338, cross member 346, release member 344 and grip arm 343 operating generally as described for the like numbered items with reference to FIGS. 1A and 1B. As further shown in FIG. 3A, the latching member 338 includes a connecting arm 339 extending from and connecting the cross member 346 to the grip arm 343. The release member 344 couples to the connecting arm 339 adjacent the cross member 346. The toggle member 320 further includes a hinge pin 322 at an end of a hinge arm 328 of the toggle member 320.

FIGS. 3A and 3B also show further details of the structures of the toggle member 320 positioned, in use, in the body cavities 132 which are not shown in FIGS. 1A and 1B. One of the passages 336' is shown extending through the toggle member 320 in FIGS. 3A and 3B. As is clear from the illustrations in FIGS. 3A and 3B the passage 336' (136, 136' in FIGS. 1A and 1B) need not be an enclosed passage and may be provided only sufficient structure to provide retention of a conductor therein in cooperation with the sidewall of the body cavity 132 in the base 110 (see FIG. 1A). In addition, FIGS. 3A and 3B illustrate an insulation displacement connector (IDC) receiving chamber 324 extending across the passage 336'. The IDC receiving chamber 324 is positioned so that the IDC connector end of the connector 130, 130' may pass from below the toggle member 320 through the plane of the passage 336' so as to intercept and engage a conductor in the passage 336' on rotation of the toggle member 320 to the conductor terminating position. An end wall receiving opening 326 is also shown in FIGS. 3A and 3B. The chamber 326 is provided to receive the end wall on the end 142 of the base 110 when the toggle member is inserted into a base 110.

As shown in FIGS. 3A and 3B, the retention member 360 is an increased width portion of the toggle member 320 that extends at an angle $\alpha$ selected to provide a greater contact area with the base 110 when the toggle member 320 is rotated from the conductor terminating position past the conductor receiving position than when the toggle member 320 is installed in the base 110. As shown in FIG. 3B a front face 329 of the toggle member 320 at an end thereof opposite the hinge pin 322 includes two tapered entrance conductor receiving openings 334, 334'.

Figure 4A:
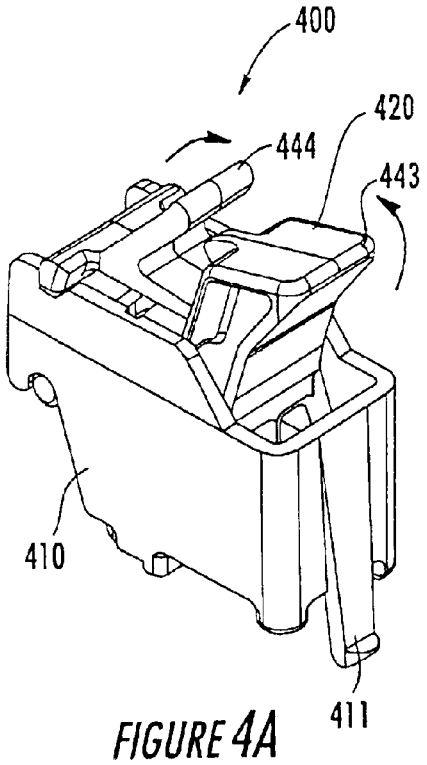
FIGS. 4A–4C are perspective views illustrating attachment of conductors to a terminal block according to some embodiments of the present invention.
Figure 4B:
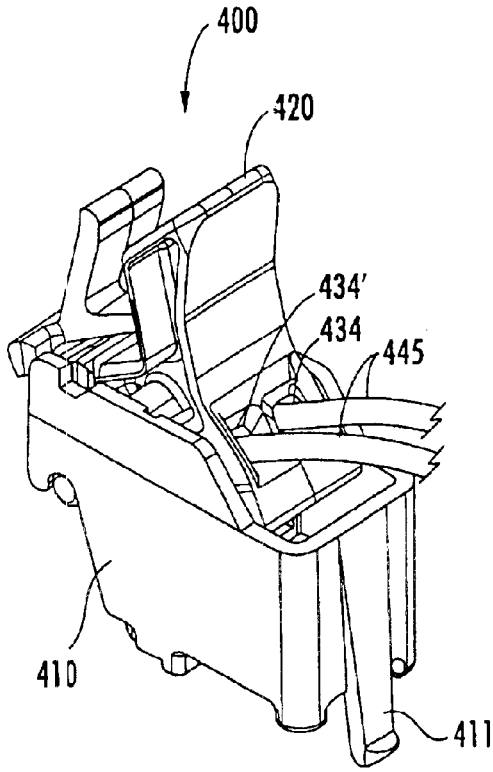
Figure 4C:
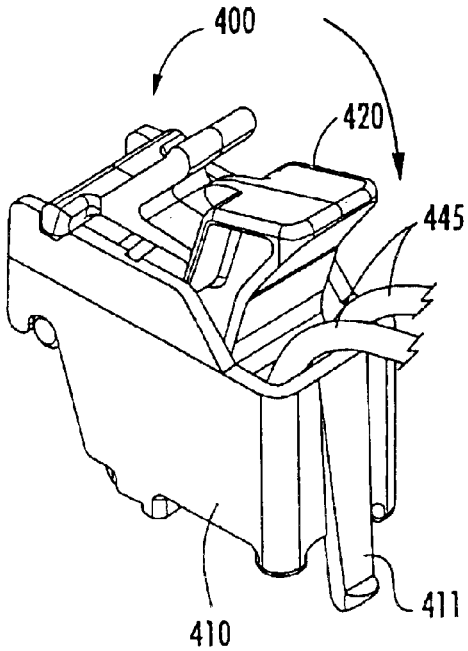

Operations for terminating or attaching conductors to a terminal block according to some embodiments of the present invention will now be described with reference to FIGS. 4A–4C. Note that a single station terminal block 400 is illustrated in FIGS. 4A–4C. As shown in FIG. 4A, the toggle member 420 is positioned in a latched state in the base 410. The base 410 includes a hooked connecting member 411 that may be used for snapping the terminal block 400 into a mounting member, such as a frame or Network Interface Device (NID). The member 411 may be a flexible member to allow repeated insertion and removal of the terminal block 400 in a mounting frame. As shown by the counter rotation arrows in FIG. 4A, to allow movement of the toggle member 420 so that conductors may be inserted, the release arm 444 and grip member 443 are pressed towards each other. Toggle member 420 is then moved to the conductor receiving position and conductor wires 445 are inserted through the openings 434, 434' as shown in FIG. 4B. The toggle member 420 is then rotated back to the conductor terminating position as illustrated in FIG. 4C to make an electrical connection to the wires 445, for example, by passing the conductors 445 into respective insulation displacement connector (IDC) portions of a connector 130, 130'.

Figure 5A:
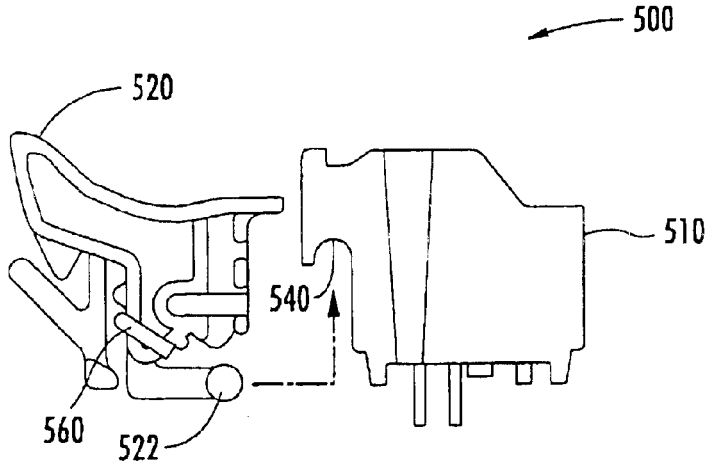
FIGS. 5A–5C are perspective views illustrating attachment of a toggle member to a base according to some embodiments of the present invention.
Figure 5B:
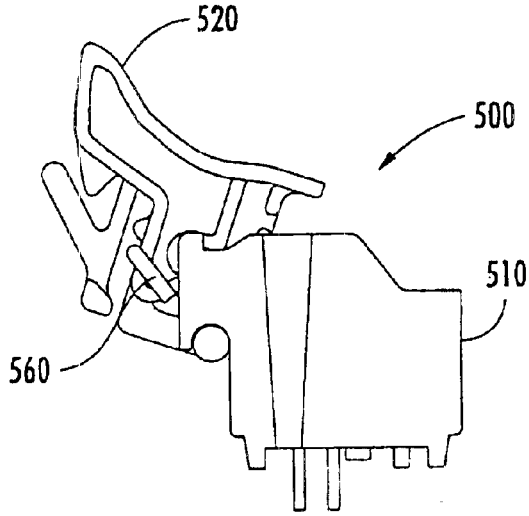
Figure 5C:
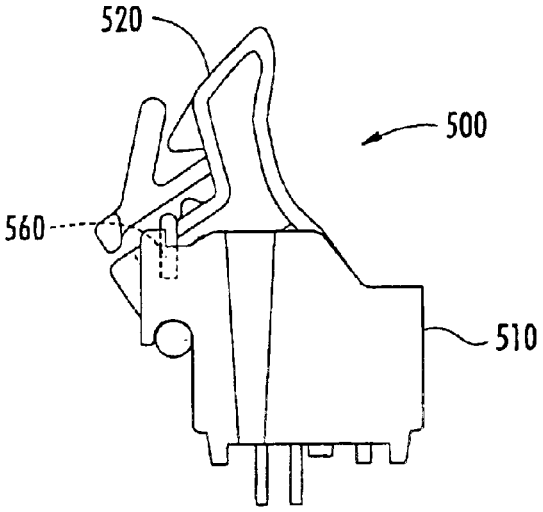

Operations of a retention member, such as the retention member 160 illustrated in FIG. 1B, will now be further described with reference to FIGS. 5A–5C. FIGS. 5A–5C are perspective views of a terminal block 500 according to further embodiments of the present invention illustrating insertion of a toggle member. As shown in FIG. 5A, the toggle member 520 is moved towards the base 510, in the direction shown by the arrow, to position the hinge arm 522 in the hinge member 540 or the base 510. The toggle member 520 is then rotated as shown in FIG. 5B. FIG. 5B shows the angle of contact between the retention member 560 and the end of the base 510 while the toggle member 520 is being rotated in a clockwise direction during installation into the base 510. FIG. 5C shows the angle of contact between the retention member 560 and the base 510 after rotation through the connector receiving position in the counterclockwise direction to limit further counterclockwise rotational movement of the toggle member 520. As a result of the different contact angles between the retention member 560 and the base 510 in the respective rotational directions, a greater contact area of the toggle member 520 with the base 510 is provided when the toggle member 520 is rotated from the conductor terminating position past the conductor receiving connection than when the toggle member 520 is installed in the base 510.

Figure 6A:
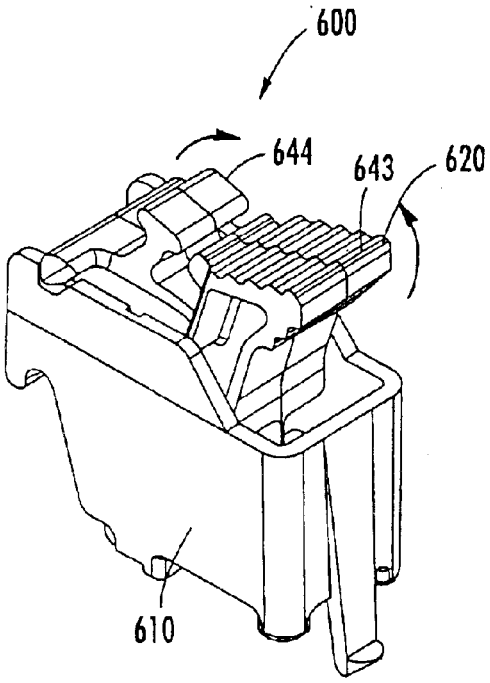
FIGS. 6A–6C are perspective views illustrating attachment of conductors to a terminal block according to some embodiments of the present invention.
Figure 6B:
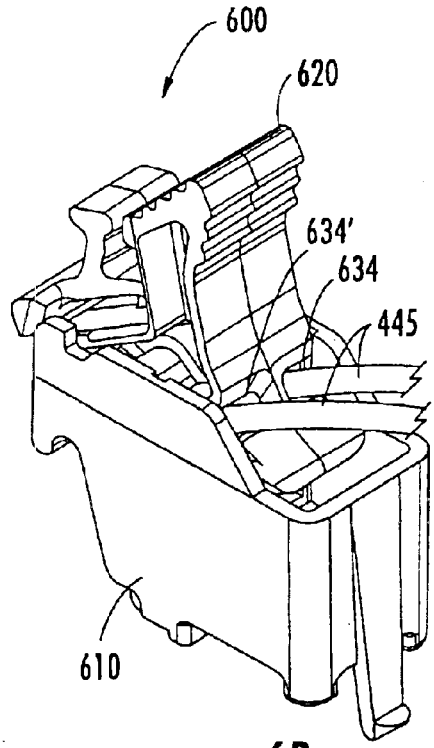
Figure 6C:
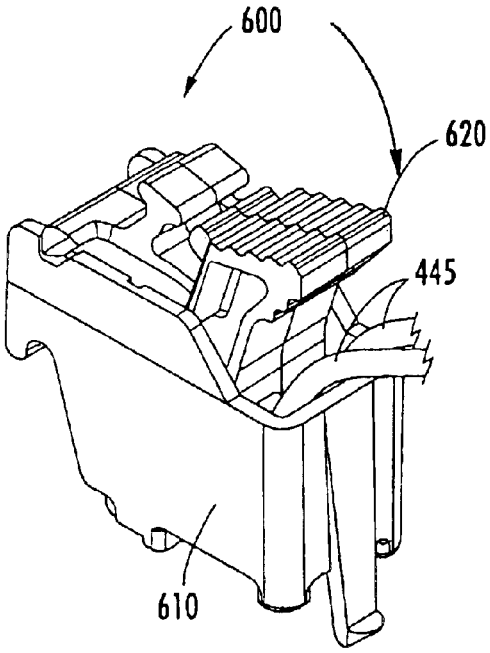

Conductor terminating operations for further embodiments of the present invention will now be described with reference to the perspective view illustrations of FIGS. 6A–6C. As shown in FIG. 6A, the terminal block 600 is latched in the conductor terminating position with the toggle member 620 positioned in the base 610. The release arm 644 and grip arm 643 are pressed towards each other as indicated by the arrows in FIG. 6A to release the latch member from the latch position so as to allow rotational movement of the toggle member 620. As shown in FIG. 6B, the toggle member 620 has been rotated to the conductor receiving position and the telecommunication conductors 445 have been inserted through the openings 634, 634'. As shown in FIG. 6C, the toggle member 620 is then rotated back to the conductor terminating position to establish an electrical connection to the conductors 445.

Figure 7A:
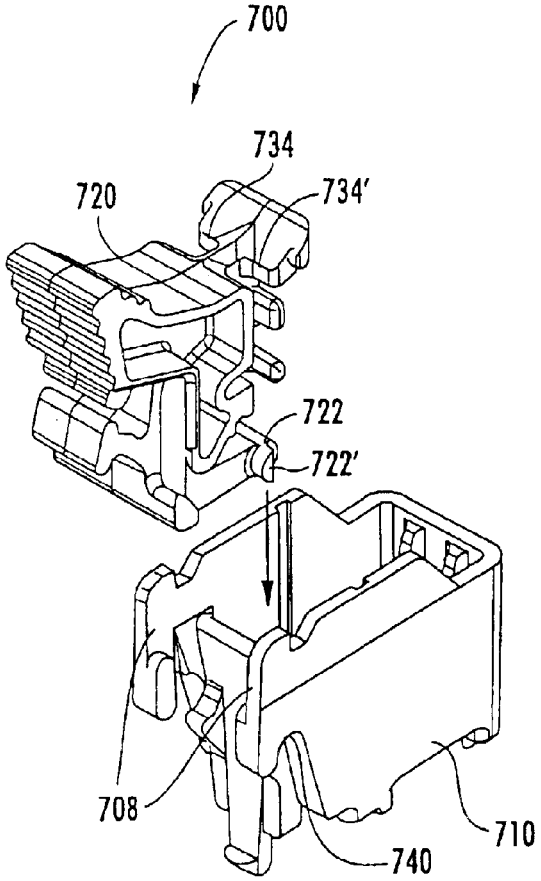
FIGS. 7A–7C are perspective views illustrating attachment of a toggle member to a base according to some embodiments of the present invention.
Figure 7B:
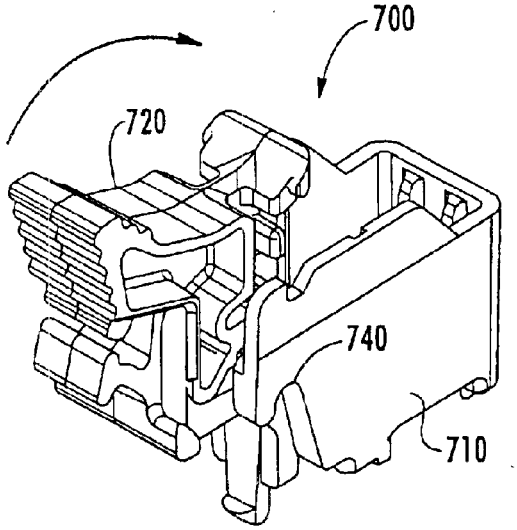
Figure 7C:
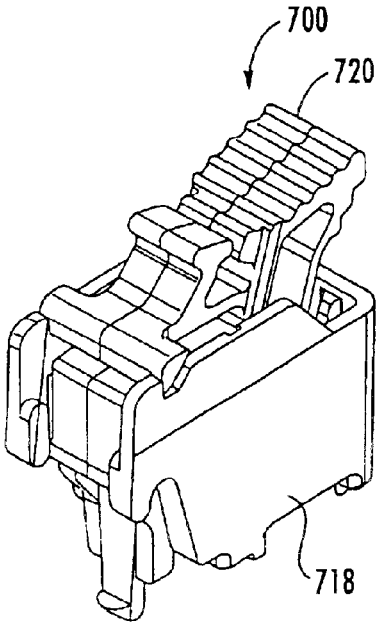

Further distinct embodiments of the present invention and assembly thereof will now be described with reference to the perspective view illustrations of FIGS. 7A–7C. As shown in FIG. 7A, the terminal block 700 includes a body 710 and a toggle member 720. The toggle member 720 is inserted into the base 710 by movement in the direction shown by the arrow in FIG. 7A. The toggle member 720 includes conductor receiving openings 734, 734' that differ from those illustrated in FIGS. 1A and 3B in that they are channel shaped and opened to the sides. The toggle arm 720 further includes a hinge pin 722 that differs from that described previously with reference to FIGS. 3A and 3B. In particular, the hinge pin 722 includes hemispherical portions 722' on the ends thereof. The hemispherical portions 722' are provided and oriented so that when the toggle member 720 is moved towards the base 710 in the direction indicated in FIG. 7A, a reduced cross-sectional contact area is provided while the toggle member 720 is passed between the flanges 708 of the base 710. As shown in FIG. 7B, the toggle arm is advanced a distance sufficient to allow engagement of the hinge pin 722 in the hinge member 740 of the base 710. The toggle member 720 may then be rotated into the latched, conductor terminating position as illustrated in FIG. 7C.

Figure 8:
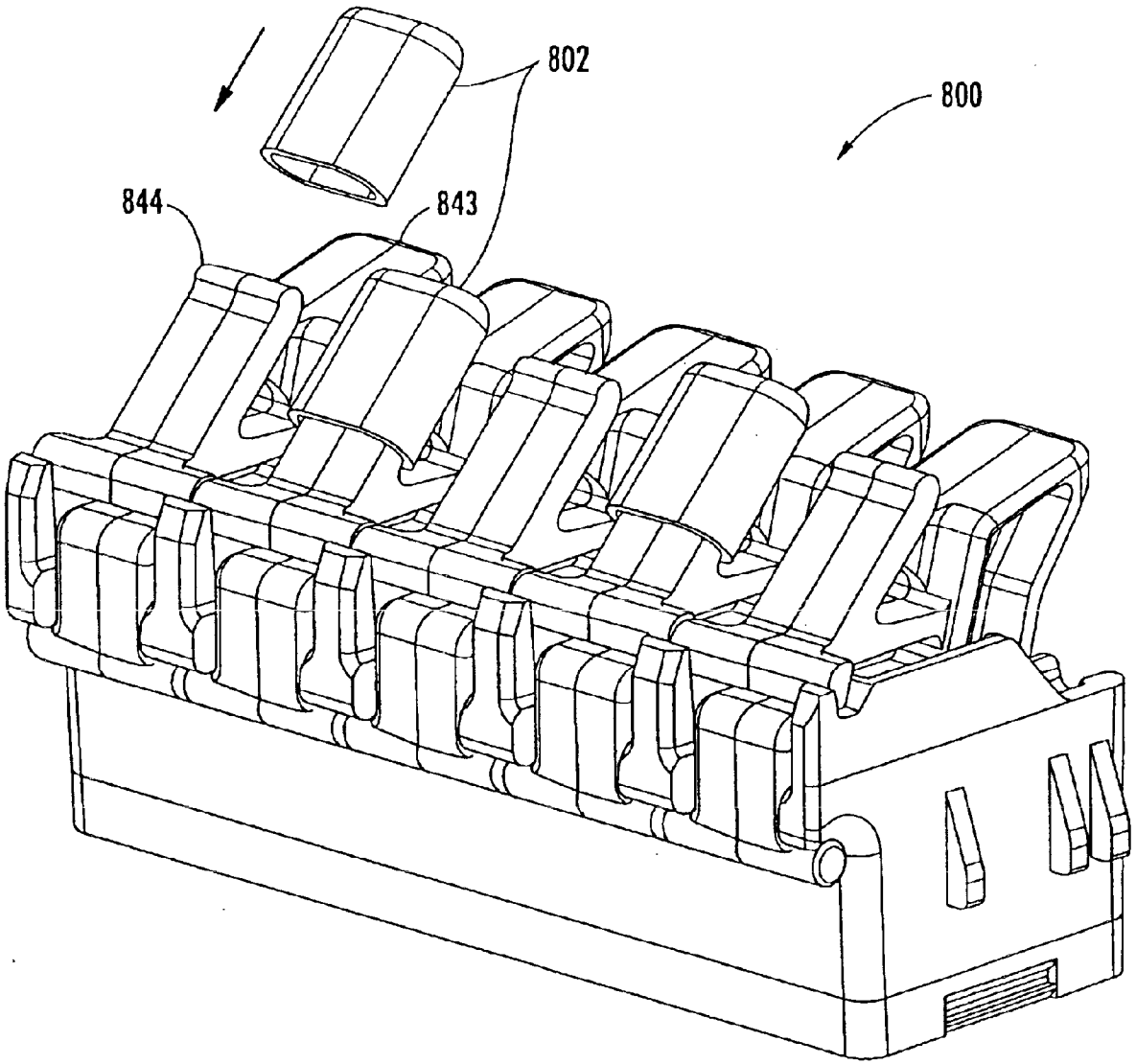
FIG. 8 is a perspective view of terminal blocks according to some embodiments of the present invention including a circuit marker.

FIG. 8 illustrates further embodiments of a telecommunications terminal block 800 according to the present invention. In particular, the embodiments illustrated in FIG. 8 include a visible circuit marker 802. As shown by comparison of the left most station and the adjacent station of the terminal block 800 in FIG. 8, the visible circuit marker 802 may be removably coupled to the terminal block 800, for example, by positioning the visible circuit marker 802 over the release arm 844. The circuit marker 802 may then be readily visible to a user of the terminal block 800, such as a telecommunications technician, as an indication of used stations of the terminal block 800. The circuit marker 802 may be made of a bright color, such as red, to further enhance the visibility of the indication provided to a user by the presence of the circuit marker 802. The circuit marker 802 may also operate to affect the ability of a user to operate the associated station of the terminal block 800. For example, for the embodiments illustrated in FIG. 8, the circuit markers 802 are provided with a sufficient wall thickness so that, when the circuit marker 802 is positioned over the release arm 844, the gap between the release arm 844 and the grip arm 843 is sufficiently reduced so as to limit flexing movement of the release arm 844. As a result, the latching member may be kept in the latched state and limit movement of the toggle member from the conductor terminating to the conductor receiving position.

Figure 9:
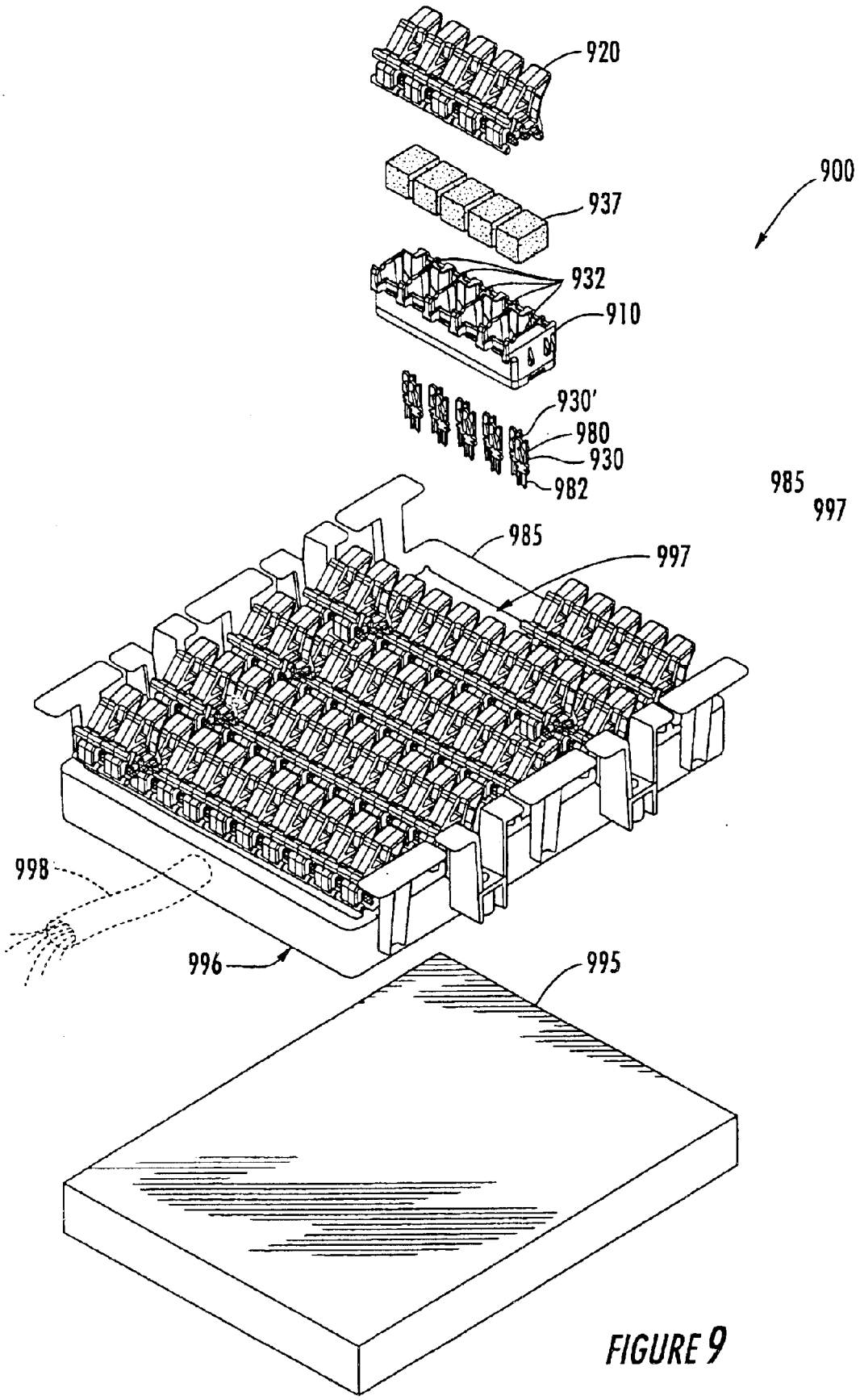
FIG. 9 is an exploded perspective view of a cross-connect assembly according to some embodiments of the present invention.

Referring flow to the exploded perspective view of FIG. 9, embodiments of terminal blocks in the present invention used in a cross-connect assembly will now be further described. The cross-connect assembly 900 of FIG. 9 includes a plurality of terminal blocks, one of which is shown in exploded perspective and will be described herein. However, it is to be understood that others of the terminal blocks may be configured in substantially the same manner. It is also to be understood that, while five station terminal blocks are illustrated in FIG. 9, other combinations, including the use of a plurality of single station terminal blocks, may also be used in accordance with the present invention.

As shown in FIG. 9, the terminal block unit for use in the cross-connect assembly 900 includes toggle arms 920 rotatably connected to a base 910. An environmental sealant, such as a silicone gel 937, is positioned in body cavities 932 of the base 910. Each of the body cavities 932 also includes a first and second connector 930, 930' mounted therein.

As shown in FIG. 9, each of the connectors 930, 930' includes a wire termination connection on respective opposite ends thereof. On the end positioned in the body cavity 932, an insulation displacing connector (EDC) 980 is provided. The IDC 980 is configured and positioned to engage a conductor in an associated one of a conductor receiving passages when the conductor is pressed into the IDC 980. A second connection region 982 is positioned on an opposite end of the connector 930, 930'. The second connection region 982 extends from an external surface of the base 910 so as to be accessible from outside of the base 910 for connection of wires thereto, such as one or more of the wires from the telecommunications conductor cable 998.

As shown in FIG. 9, the various terminal blocks are positioned in a mounting member 985. The wires of the telecommunications conductor cable 998 extend into a lower chamber 996 of the mounting member 985. A plurality of openings 997 on the top side of the mounting member 985 are configured to receive the terminal blocks. The openings 997 are in communication with the chamber 996 to allow routing of the wires of the telecommunications cable 998 to the second connection regions 982. As also shown in FIG. 9, an environmental sealant, such as a potting compound 995, may be positioned in the chamber 996 to provide environmental sealing around the second connection regions 982. It is to be understood that the cable 998 may also extend directly from the potting compound 995 without passing through a wall of the lower chamber 996.

Figure 10B:
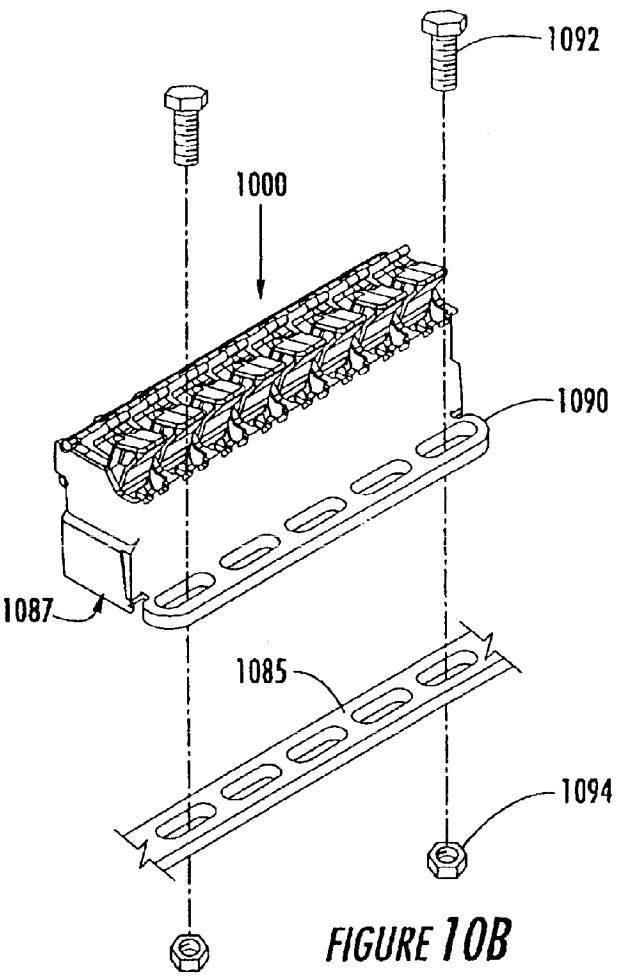
FIG. 10B is an exploded perspective view illustrating attachment of the terminal block of FIG. 10A to a mounting member according to some embodiments of the present invention.
Figure 10A:
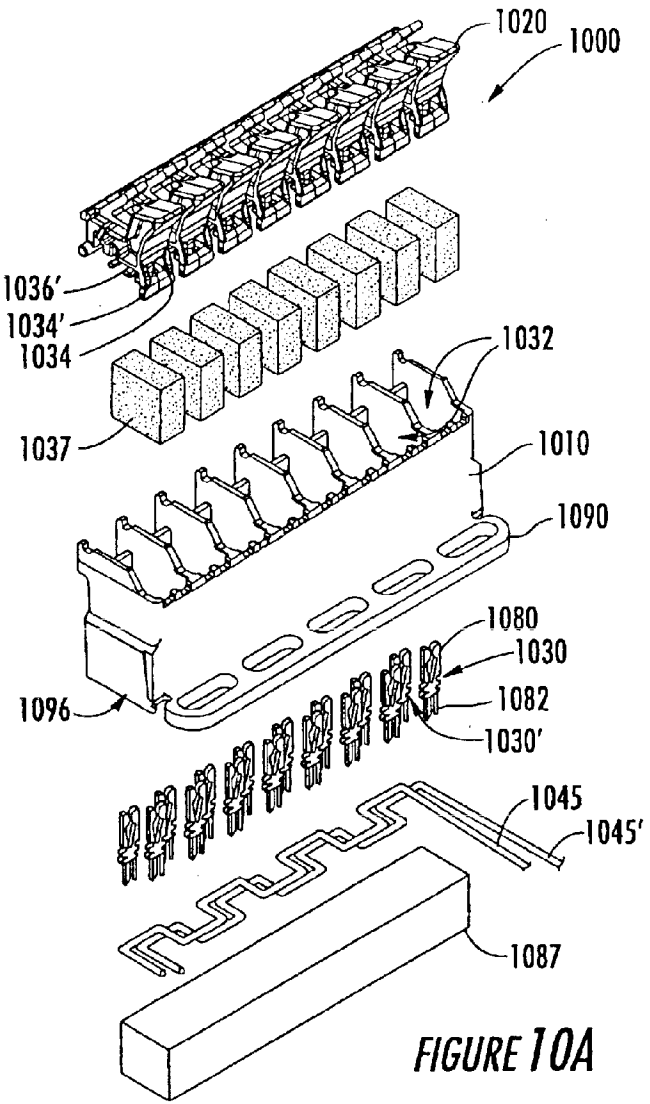
FIG. 10A is an exploded perspective view of a multiple toggle terminal block that may be used as a cross-connect assembly according to other embodiments of the present invention.

Referring now to FIGS. 10A and 10B, further embodiments of a terminal block 1000 in accordance with the present invention configured in a manner suitable for use in a variety of applications, including as a cross-connect assembly, will be described. As shown by the exploded perspective view in FIG. 10A, the terminal block 1000 includes a plurality of toggle members 1020 for rotational mounting in a base 1010. The base 1010 defines a body cavity 1032 for receiving each of the toggle members 1020. Each body cavity 1032 includes two connectors 1030, 1030'. A first (or "tip") connector in each body cavity is commonly connected to a conductor 1045 at the second connection region 1082 thereof and a second (or "ring") connector in each body cavity is commonly connected to a connector 1045'. An environmental sealant, such as a silicone gel 1037, is positioned in each of the body cavities 1032. An environmental sealant, such as a potting compound 1087, provides environmental protection for the second connection regions 1082 connected to the wires 1045, 1045'. For example, the potting compound 1087 may be located in a lower chamber 1096 of the base 1010.

As described with reference to the embodiments of FIGS. 1A and 1B, the toggle members 1020 may include first and second conductor receiving openings 1034, 1034' and conductor receiving passageways 1036'. The base 1010, as illustrated in FIG. 10A, further includes an attachment member 1090. As shown in FIG. 10B, the attachment member 1090 is configured to couple the terminal block 1000 to a frame, such as the cross member 1085. The attachment member 1090, as shown in FIG. 10B, operates in conjunction with bolt 1092 and nut 1094 to connect the terminal block 1000 to the frame 1085. However, it will be understood that other attachment means, including clips, adhesives, screws and the like may be used in various embodiments of the present invention.

While the embodiments illustrated in FIG. 10A and FIG. 10B include eight termination stations, it is to be understood that other combinations, including single station terminal blocks, may be used. Furthermore, while it was noted that the embodiments illustrated in FIG. 10A and FIG. 10B may be used in a cross-connect assembly, it is to be understood that they are not limited to use in such a context. For example, with the common lip and common ring wiring connection as illustrated in FIG. 10A, the terminal block 1000 may be suited to use in a network interface device (NID) environment to provide multiple connection points for a customer to a single telephone company (TELCO) tip and ring wire pair. It will also be understood that multiple wire pairs 1045, 1045' may be provided for connection to the second connection regions 1082 for independent electrical connections being established to telecommunication conductors in the IDCs 1080. In addition, the wire pair 1045, 1045' need not extend from the base 1010 of the terminal block 1000 as the respective connections on the second connection regions 1082 may provide cross connects between stations rather than being used to provide connections to externally extending telecommunications conductors. This is likewise true for the embodiments illustrated in FIG. 9, where different stations may be interconnected rather than providing for an externally extending telecommunications conductor cable 998.

As described above, various embodiments of the present invention may provide for convenient re-entrable telecommunications connections. Furthermore, the use of removable toggle members positioned in bases may provide for ready replacement of damaged or broken components without requiring replacement of an entire terminal block or cross-connect assembly. In particular embodiments, the toggle member 120 may comprise a softer material than the base 110. Furthermore, portions of the toggle member 120 and the base 110 subjected to forces when the toggle member 120 is rotationally moved may be sized so that the toggle member 120 will fail before the base 110 on repeated use. This may be particularly beneficial in embodiments providing multiple stations so that, when damage is limited to a single station, repairs may be affected by replacing a single toggle arm 120 rather than requiring the removal of the entire terminal block 100. In various embodiments of the present invention, for example, the toggle member 120 comprises a polycarbonate material, such as Lexan™ 143R available from General Electric Corp. or PC-10R-WT7327V available from Polymer Technologies & Services, LLC and the base is a Polycarbonate/Polybutylene Terephthalate blend w/30% glass, such as Valox™ 508 or ValoXTA 553 available from General Electric Corp. The use of hinge members having a bearing surface of less than 180°, such as the 110° bearing surface illustrated in FIG. 1A, may further facilitate easy removal and replacement of toggle members 120.

As is also shown, for example, in FIGS. 3A and 3B, conductor receiving passages 336' having an open face or faces may be used with the present invention. The use of open faced, as opposed to closed passages, may be beneficial for clearing out insulation scrap introduced into the passage 336' during repeated use and passing such insulation scrap into the environmental sealant gel or out of the body cavity to reduce the likelihood of jams or other problems increasing the difficulty of opening and closing the toggle member 320. The use of body cavities as described for the various embodiments above may also be particularly beneficial in providing for effective environmental sealing of the connections to the connectors positioned in the body cavities. For example, by providing a body cavity that is devoid of openings up to at least an environmental sealant fill level, an environmental sealant, such as a silicone gel, may be readily placed into the body cavities in a liquid form. This may provide for improved manufacturing efficiencies and improved positioning of the gel in the region of the electrical connections. Placement of the hinge member 140 on an external surface of the base 110 may also facilitate environmental sealing by keeping the hinge member outside the environmental sealant region of the body cavity 134.

Figure 11:
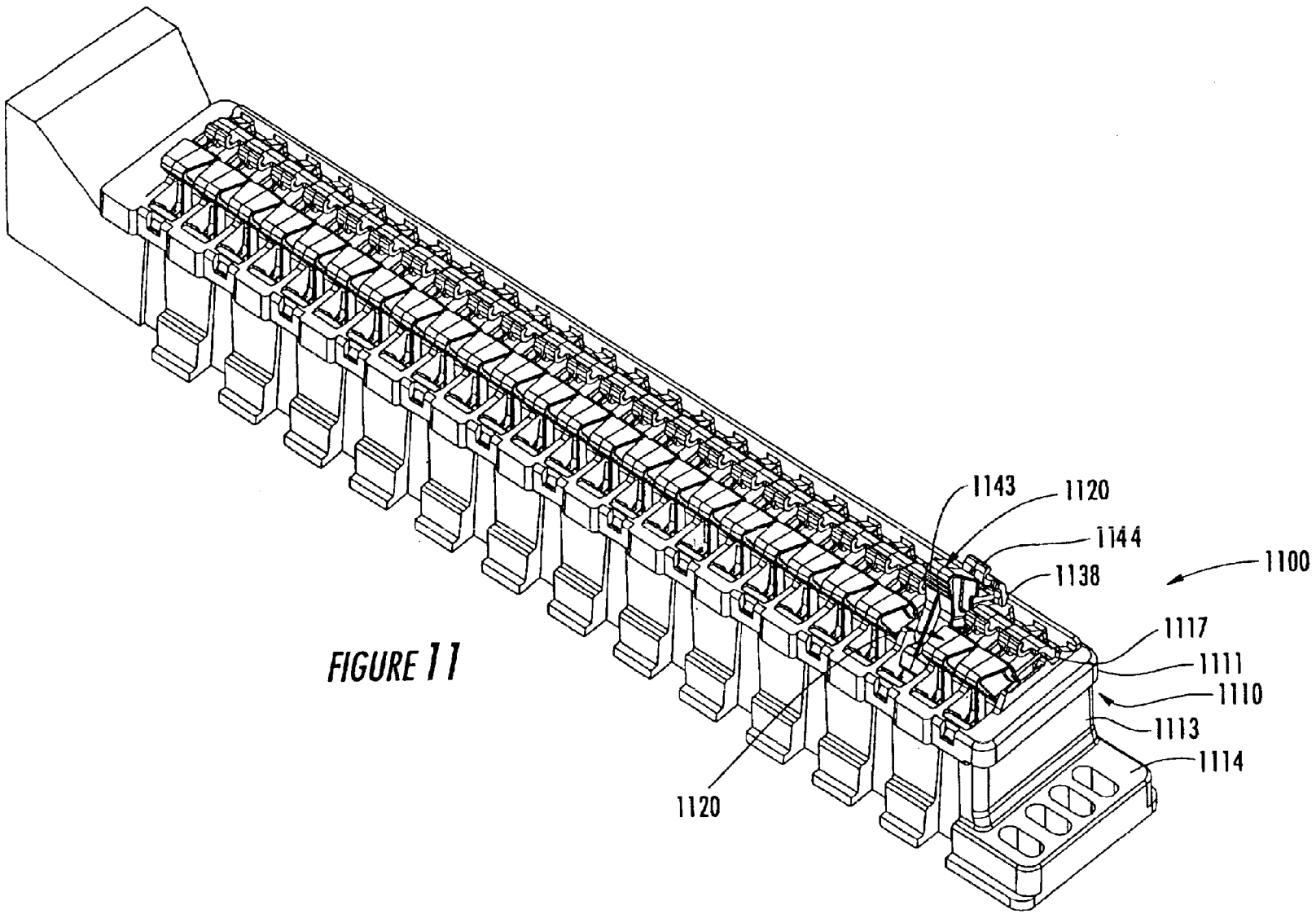
FIG. 11 is a perspective view of further embodiments of a terminal block.
Figure 12:
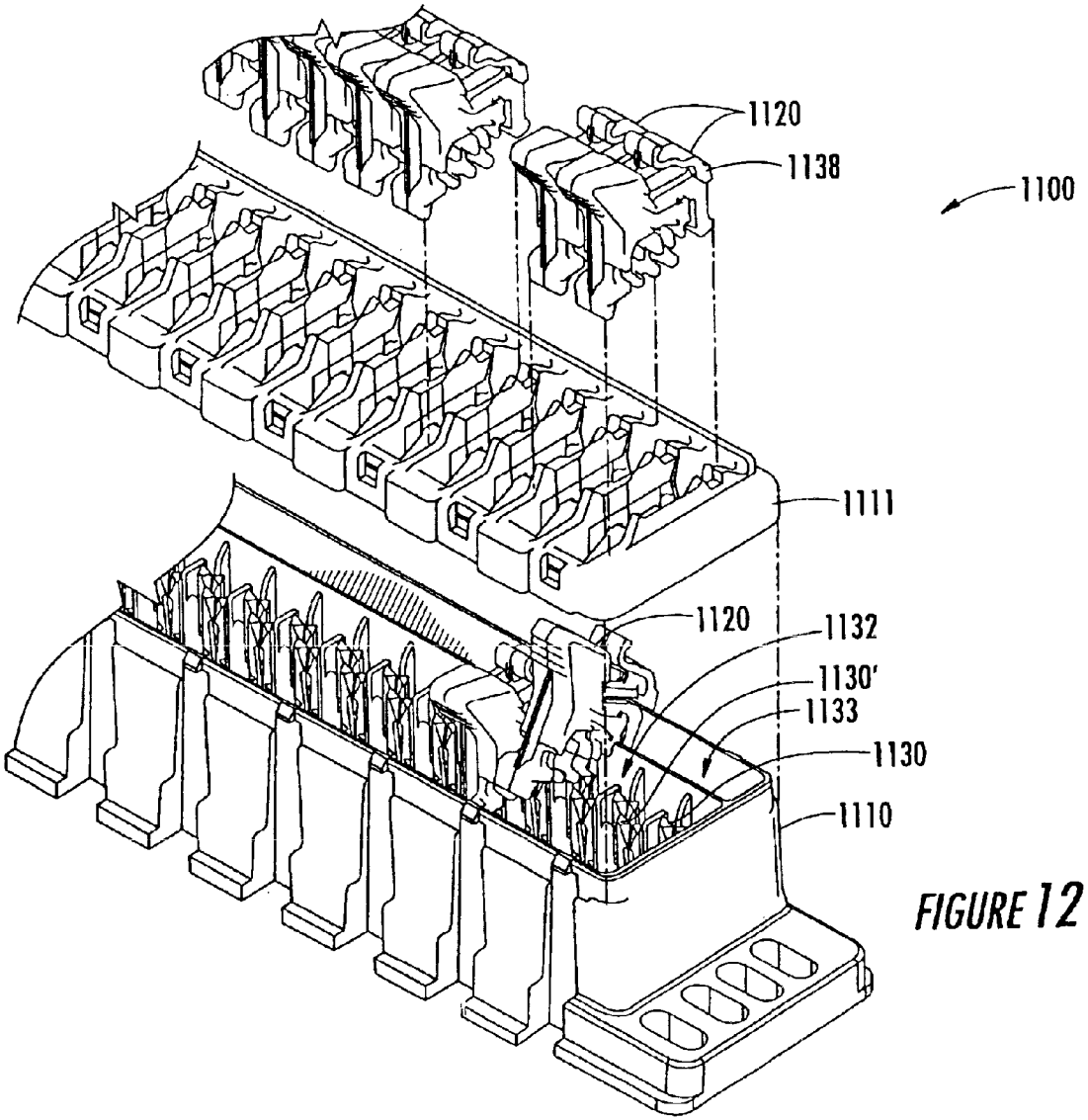
FIG. 12 is an exploded perspective view of the terminal block of FIG. 11.
Figure 13:
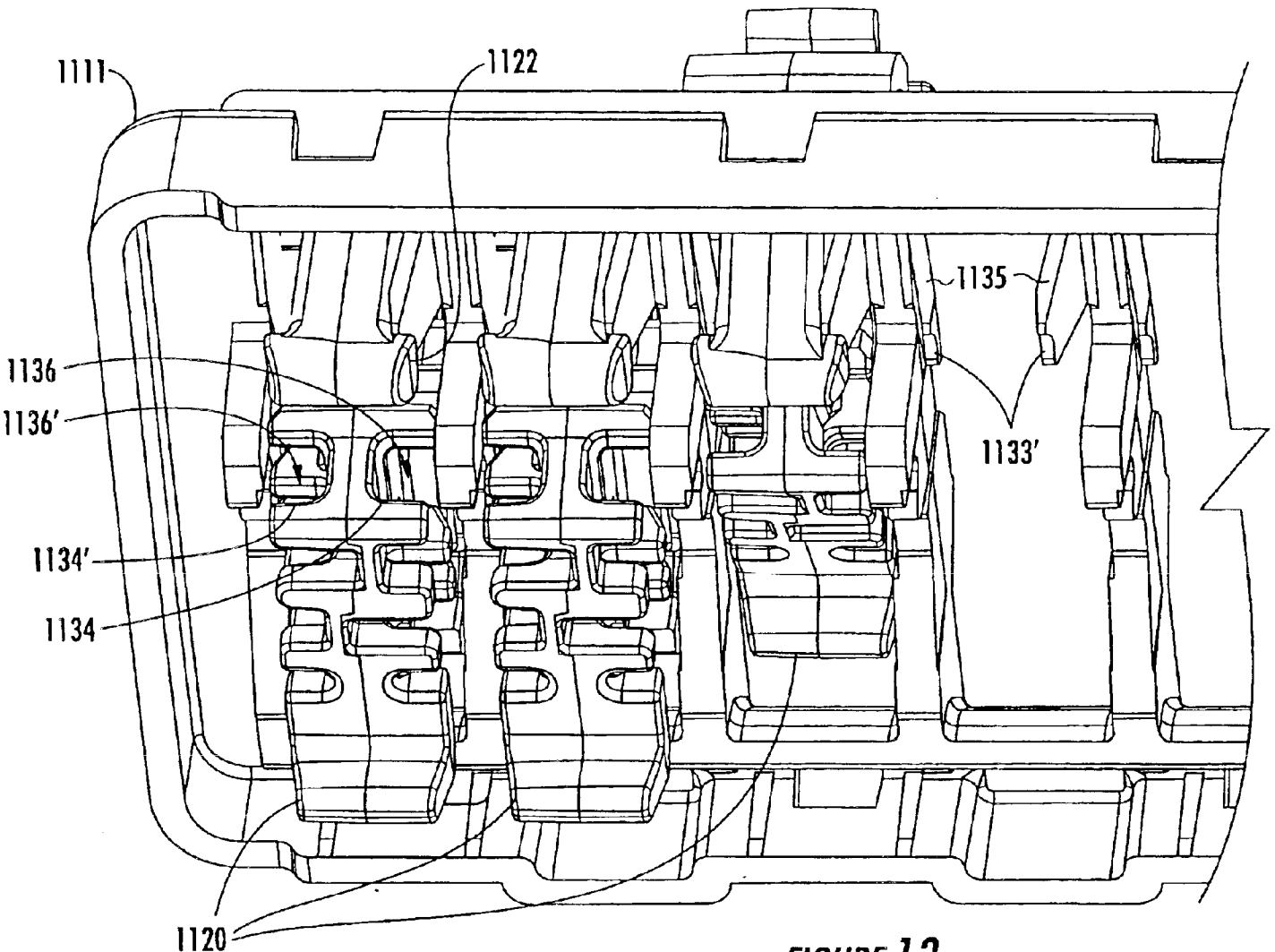
FIG. 13 is a bottom perspective view of the cover of the terminal block of FIG. 11.

Further embodiments of a terminal block will now be described with reference to FIGS. 11–14. As shown in FIGS. 11 and 12, the terminal block 1100 includes a two-piece base 1110 including a lower piece 1113 and a cover 1111. A number of toggle members 1120 are rotatably connected to the base 1110 at an end thereof. The base 1110 defines a plurality of body cavity portions 1132 therein. First and second connectors 1130, 1130' are mounted in the base 1110 for each body cavity portion 1132 and extend into the body cavity portions 1132. The first and second connector 1130, 1130' in each station may be associated with respective "tip" and "ring" wires of a telephone connection. The toggle members 1120 are connected to the base 1110 by a two part hinge with a lower portion defined by the hinge cavity 1133 of the lower piece 1113 and an upper portion, as illustrated in FIG. 13, defined by the arched ends 1133' of the arms 1135 of the cover 1111. The toggle members include a hinge pin 1122 that is rotatably received between adjacent portions of the hinge cavity 1133 and the arched ends 1133' of the arms 1135. The toggle members 1120 may be removably positioned in the cover 1111 before the cover is mounted to the lower piece 1113 during assembly of the terminal block 1100.

Figure 14:
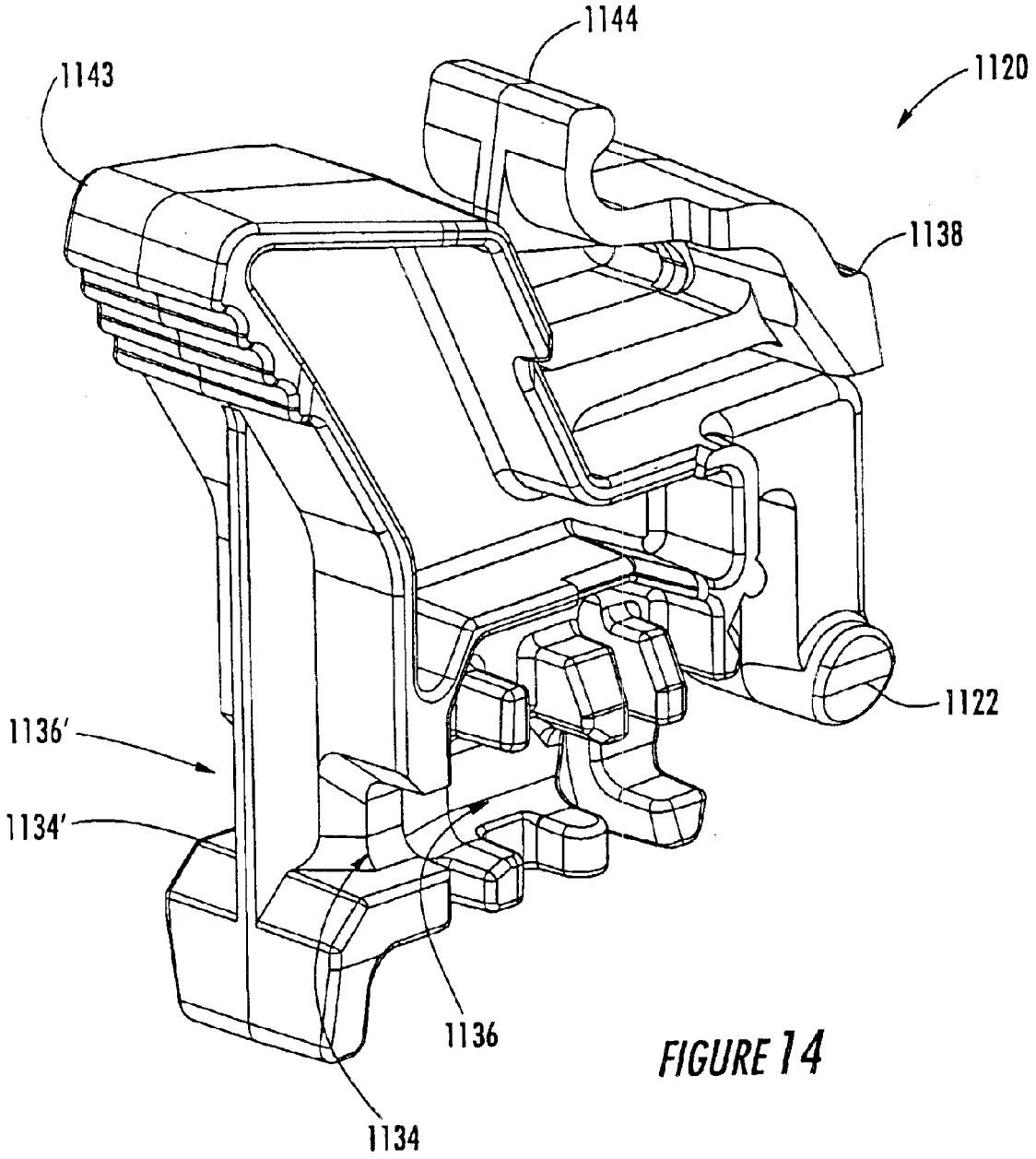
FIG. 14 is a perspective view of the toggle member of the terminal block of FIG. 11.

As illustrated in FIGS. 13 and 14, the toggle members 1120 are configured to receive a pair of telecommunications terminal conductors and make and break an electrical connection between the telecommunications conductors and the connectors 1130, 1130' (FIG. 12). In particular, the toggle members 1120 each have first and second conductor receiving openings 1134, 1134' in one end thereof. Respective first and second conductor passages 1136, 1136' extend from the openings 1134, 1134' past respective ones of the connectors 1130, 1130'.

The toggle members 1120, as illustrated in FIGS. 11 and 14, further include a latching member 1138. The latching member 1138 provides for a latched closed position for each toggle member 1120 in one state and a further state in which the toggle members 1120 may be rotated for removal and insertion of conductors therein. Thus, referring to FIG. 11, all but one of the toggle members 1120 are in the latched state locking the toggle members 1120 in a conductor terminating position in which a conductor in the first or second conductor passage 1136, 1136' may be electrically connected to the respective one of the connectors 1130, 1130'. On of the toggle members 1120 is in a state allowing rotation of the toggle member 1120 and shows the toggle member 1120 rotated to a conductor receiving position in which conductors may be inserted through the openings 1134, 1134' into the passages 1136, 1136' in preparation for making an electrical connection with the connectors 1130, 1130'.

To facilitate operation of the latching member 1138, the toggle member 1120 further includes a release member 1144 coupled to the toggle member 1120 that is configured to allow movement of the latching member 1138 from the latched state (also referred to herein as the second state) to the moveable state (also referred to herein as the first state). As shown in FIG. 11 and FIG. 14, the release member 1144 is a lever arm on the toggle member 1120 coupled to the latching member 1138. The latching member 1138 is positioned to contact a stop member 1117 of the cover 1111 when the latching member 1138 is in the latched state. The lever arm 1144 may be flexed to allow the latching member 1138 to by-pass the stop member 1117 so as to allow rotational movement of the toggle member 1120 to the conductor receiving position. To facilitate flexing of the release member 1144 so that the toggle member 1120 may be rotated, the toggle member may, as illustrated in FIGS. 11 and 14, further include a grip arm 1143 allowing a user to pinch the grip arm 1143 and release arm 1144 toward each other and rotate the toggle member 1120.

As shown in FIGS. 11 and 14, the release member 1144 is positioned adjacent an end of the base where the toggle member is hinged and opposite the end having the conductor receiving openings 1134, 1134' so that conductors extending from the openings 1134, 1134' need not pass adjacent the release member 1144.

An environmental sealant may be placed in the body cavity portions 1132 to facilitate environmental protection of the connection between the telecommunication conductors and the connectors 1130, 1130'. Electrical connections to a bottom end of the connectors 1130, 1130' in a bottom chamber of the base 1110 need, in various embodiments, not be re-entrable and may be environmentally sealed by an environmental sealant such as a potting compound.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A telecommunications terminal block for making and breaking connections with a telecommunications conductor, said terminal block comprising:

a unitary base defining a body cavity, the base including a hinge member at an end thereof;

first and second connectors mounted in the base and extending into the body cavity;

a toggle member rotatably connected to the base at the hinge member, the toggle member having first and second conductor receiving openings therein and a first and second conductor passage extending from the respective openings past respective ones of the connectors;

an environmental sealant material positioned in the body cavity;

a latching member having a first state allowing rotation of the toggle member to a conductor receiving position and a second state locking the toggle member in a conductor terminating position in which a conductor in the first or second conductor passage is electrically connected to a respective one of the first or second connector; and a release member coupled to at least one of the base and the toggle member that is configured to allow movement of the latching member from the second state to the first state, wherein the release member is positioned adjacent the end of the base having the hinge member so that conductors extending from the openings do not pass adjacent the release member; and wherein the latching member comprises a cross member on the toggle member positioned to contact a lead edge of at least one stop arm on the base in the second state of the latching member and to bypass the lead edge in the first state and wherein the release member comprises a lever arm on the toggle member coupled to the cross member having a rest position in which the latching member is in the second state and a flexed position in which the latching member is in the first state.

2. A telecommunications terminal block for making and breaking connections with a telecommunications conductor, said terminal block comprising:

a base defining a body cavity the base including a hinge member on an external surface of the base at an end thereof;

first and second connectors mounted in the base and extending into the body cavity;

a toggle member rotatable connected to the base at the hinge member, the toggle member having first and second conductor receiving openings therein and first and second conductor passages extending from the respective openings past respective ones of the connectors;

an environmental sealant material positioned in the body cavity and at least partially surrounding the first and second connector;

a latching member having a first state allowing rotation of the toggle member to a conductor receiving position and a second state locking the toggle member in a conductor terminating position in which a conductor in the first or second conductor passage is electrically connected to a respective one of the first or second connector: and a release member coupled to at least one of the base and the toggle member that is configured to allow movement of the latching member from the second state to the first state, wherein the release member is positioned adjacent the end of the base having the hinge member so that conductors extending from the openings do not pass adjacent the release member; and wherein the latching member comprises a cross member on the toggle member positioned to contact a lead edge of at least one stop arm on the base in the second state of the latching member and to bypass the lead edge in the first state and wherein the release member comprises a lever arm on the toggle member coupled to the cross member having a rest position in which the latching member is in the second state and a flexed position in which the latching member is in the first state.

3. A telecommunications terminal block for making and breaking connections with a telecommunications conductor, said terminal block comprising:

a base defining a body cavity, the base including a hinge member on an external surface of the base at an end thereof;

first and second connectors mounted in the base and extending into the body cavity;

a toggle member rotatably connected to the base at the hinge member, the toggle member having first and second conductor receiving openings therein and first and second conductor passages extending from the respective openings past respective ones of the connectors; and an environmental sealant material positioned in the body cavity and at least partially surrounding the first and second connector;

wherein the toggle member comprises a removable toggle member and wherein the toggle member further comprises a retention member configured to limit rotational movement of the toggle member beyond a conductor receiving position; and wherein the retention member is configured to require a first force to rotate the toggle member beyond the conductor receiving position to remove the toggle member from the base and a second force, lower than the first force, to install the toggle member in the base for rotational movement between the conductor receiving position and a conductor terminating position.

4. A telecommunications terminal block for making and breaking connections with a telecommunications conductor, said terminal block comprising:

a base defining a body cavity, the base including a hinge member at an end thereof;

a first and second connector mounted in the base and extending into the body cavity;

a toggle member rotatably connected to the base at the hinge member, the toggle member having a first and second conductor receiving opening therein and a first and second conductor passage extending from the respective openings past respective ones of the connectors toward the hinge member;

an environmental sealant material positioned in the body cavity and at least partially surrounding the first and second connector;

a latching member having a first state allowing rotation of the toggle member to a conductor receiving position and a second state locking the toggle member in a conductor terminating position in which a conductor in the first or second conductor passage is electrically connected to a respective one of the first or second connector; and a release member coupled to at least one of the base and the toggle member, wherein the release member has a release state in which the latching member is positioned in the first state and a non-release state in which the latching member is positioned in the second state, and wherein the release member is positioned adjacent the end of the base having the hinge member so that conductors extending from the openings do not pass adjacent the release member so that the conductors extending from the openings do not move the release member from the non-release state to the release state.

5. A telecommunications terminal block for making and breaking connections with a telecommunications conductor, said terminal block comprising:

a base including a hinge member at an end thereof;

at least one connector mounted in the base;

a toggle member rotatably connected to the base at the hinge member, the toggle member having a conductor receiving opening therein and a conductor passage extending from the opening past the at least one connector toward the hinge member;

a latching member having a first state allowing rotation of the toggle member to a conductor receiving position and a second state locking the toggle member in a conductor terminating position in which a conductor in the conductor passage is electrically connected to the connector; and a release member coupled to at least one of the base and the toggle member, wherein the release member has a release state in which the latching member is positioned in the first state and a non-release state in which the latching member is positioned in the second state and wherein the release member is positioned adjacent the end of the base having the hinge member so that conductors extending from the openings do not pass adjacent the release member so that the conductors extending from the openings do not move the release member from the non-release state to the release state.

6. A telecommunications terminal block for making and breaking connections with a telecommunications conductor, said terminal block comprising:

a unitary base defining a body cavity, the base including a hinge member at an end thereof;

first and second connectors mounted in the base and extending into the body cavity;

a toggle member rotatably connected to the base at the hinge member, the toggle member having first and second conductor receiving openings therein and a first and second conductor passage extending from the respective openings past respective ones of the connectors; and an environmental sealant material positioned in the body cavity; and wherein the toggle member comprises a softer material than the base.

7. The terminal block of claim 6 wherein portions of the toggle member and the base subject to forces when the toggle member is rotationally moved are sized so that the toggle member will fail before the base on repeated use.

8. A telecommunications terminal block for making and breaking connections with a telecommunications conductor, said terminal block comprising:

a base defining a body cavity, the base including a hinge member on an external surface of the base at an end thereof;

first and second connectors mounted in the base and extending into the body cavity;

a toggle member rotatably connected to the base at the hinge member, the toggle member having first and second conductor receiving openings therein and first and second conductor passages extending from the respective openings past respective ones of the connectors;

an environmental sealant material positioned in the body cavity and at least partially surrounding the first and second connector;

a latching member having a first state allowing rotation of the toggle member to a conductor receiving position and a second state locking the toggle member in a conductor terminating position in which a conductor in the first or second conductor passage is electrically connected to a respective one of the first or second connector; and a visible circuit marker removably coupled to the terminal block to limit movement of the toggle member from the conductor terminating position to the conductor receiving position.

9. The terminal block of claim 8, wherein the circuit marker is coupled to the release member to limit movement of the release member.

10. A telecommunications terminal block for making and breaking connections with a telecommunications conductor, said terminal block comprising:

a unitary base defining a body cavity, the base including a hinge member at an end thereof;

first and second connectors mounted in the base and extending into the body cavity;

a toggle member rotatably connected to the base at the hinge member, the toggle member having first and second conductor receiving openings therein and a first and second conductor passage extending from the respective openings past respective ones of the connectors; and an environmental sealant material positioned in the body cavity;

wherein the toggle member comprises a removable toggle member and wherein the toggle member further comprises a retention member configured to limit rotational movement of the toggle member beyond a conductor receiving position; and wherein the retention member is configured to require a first force to rotate the toggle member beyond the conductor receiving position to remove the toggle member from the base and a second force, lower than the first force, to install the toggle member in the base for rotational movement between the conductor receiving position and a conductor terminating position.

11. The terminal block of claim 10 wherein the base further comprises a toggle member receiving opening in the end thereof having the hinge member through which a portion of the toggle member moves during rotational movement of the toggle member, the receiving opening having an associated width and wherein the toggle member has a width in the portion thereof moving through the receiving opening less than the width of the receiving opening and wherein the retention member comprises an increased width portion of the toggle member positioned to contact the base at the receiving opening when the toggle is rotated past the conductor receiving position.

12. The terminal block of claim 11 wherein the increased width portion of the toggle member extends at an angle that provides a greater contact area with the base when the toggle member is rotated from the conductor terminating position past the conductor receiving position than when the toggle member is installed in the base.

13. A telecommunications terminal block for making and breaking connections with a telecommunications conductor, said terminal block comprising:

a unitary base defining a body cavity, the base including a hinge member at an end thereof, first and second connectors mounted in the base and extending into the body cavity;

a toggle member rotatably connected to the base at the hinge member, the toggle member having first and second conductor receiving openings therein and a first and second conductor passage extending from the respective openings past respective ones of the connectors;

an environmental sealant material positioned in the body cavity;

a latching member having a first state allowing rotation of the toggle member to a conductor receiving position and a second state locking the toggle member in a conductor terminating position in which a conductor in the first or second conductor passage is electrically connected to a respective one of the first or second connector; and a visible circuit marker removably coupled to the terminal block to limit movement of the toggle member from the conductor terminating position to the conductor receiving position.

14. The terminal block of claim 13 wherein the circuit marker is coupled to the release member to limit movement of the release member.

15. The terminal block of claim 13 wherein the body cavity with the connectors mounted in the base is devoid of openings up to at least an environmental sealant material fill level.

16. The terminal block of claim 15 wherein the environmental sealant material is a silicone gel that is placed in the body cavity in a liquid form.

17. A telecommunications terminal block for making and breaking connections with a telecommunications conductor, said terminal block comprising:

a unitary base defining a body cavity, the base including a hinge member at an end thereof;

first and second connectors mounted in the base and extending into the body cavity;

a toggle member rotatably connected to the base at the hinge member, the toggle member having first and second conductor receiving openings therein and a first and second conductor passage extending from the respective openings past respective ones of the connectors;

an environmental sealant material positioned in the body cavity;

a latching member having a first state allowing rotation of the toggle member to a conductor receiving position and a second state locking the toggle member in a conductor terminating position in which a conductor in the first or second conductor passage is electrically connected to a respective one of the first or second connector; and a release member coupled to at least one of the base and the toggle member, wherein the release member has a release state in which the latching member is positioned in the first state and a non-release state in which the latching member is positioned in the second state, and wherein the release member is positioned adjacent the end of the base having the hinge member so that conductors extending from the openings do not pass adjacent the release member so that the conductors extending from the openings do not move the release member from the non-release state to the release state.

18. The terminal block of claim 17 wherein the toggle member comprises a removable toggle member and wherein the toggle member further comprises a retention member configured to limit rotational movement of the toggle member beyond the conductor receiving position.

19. The terminal block of claim 17 wherein the environmental sealant comprises a gel.

20. The terminal block of claim 17 wherein the hinge member has a bearing contact surface of at least about 90 degrees.

21. The terminal block of claim 20 wherein the bearing contact surface is less than about 180 degrees.

22. The terminal block of claim 17 wherein the base defines a plurality of body cavities with respective connectors extending therein and wherein the toggle member comprises a plurality of toggle members positioned adjacent respective ones of the body cavities.

23. The terminal block of claim 22 wherein ones of the connectors comprise an insulation displacing connector on a first end thereof at least partly in the body cavity and a second connection region on an opposite end thereof extending from the base.

24. A cross-connect assembly comprising a plurality of the terminal blocks of claim 23 coupled to a mounting member and a plurality of wires, respective ones of which are connected to ones of the second connection regions.

25. The cross-connect assembly of claim 24 further comprising a potting compound around the second connection regions.

26. The cross-connect assembly of claim 24 wherein the mounting member comprises a frame and wherein the base further comprises an attachment member configured to couple the terminal block to the frame.

27. The cross-connect assembly of claim 24 wherein the mounting member comprises a panel having a chamber on a bottom side thereof that receives the plurality of wires and a plurality of openings on a top side thereof configured to receive the terminal blocks, the openings being in communication with the chamber and wherein the cross-connect assembly further comprises a potting compound in the chamber.

28. A telecommunications terminal block for making and breaking connections with a telecommunications conductor, said terminal block comprising:

a base defining a body cavity, the base including a hinge member on an external surface of the base at an end thereof;

first and second connectors mounted in the base and extending into the body cavity;

a toggle member rotatably connected to the base at the hinge member, the toggle member having first and second conductor receiving openings therein and first and second conductor passages extending from the respective openings past respective ones of the connectors;

an environmental sealant material positioned in the body cavity and at least partially surrounding the first and second connector;

a latching member having a first state allowing rotation of the toggle member to a conductor receiving position and a second state locking the toggle member in a conductor terminating position in which a conductor in the first or second conductor passage is electrically connected to a respective one of the first or second connector; and a release member coupled to at least one of the base and the toggle member, wherein the release member has a release state in which the latching member is positioned in the first state and a non-release state in which the latching member is positioned in the second state, and wherein the release member is positioned adjacent the end of the base having the hinge member so that conductors extending from the openings do not pass adjacent the release member so that the conductors extending from the openings do not move the release member from the non-release state to the release state.

29. The terminal block of claim 28 wherein the toggle member comprises a removable toggle member and wherein the toggle member further comprises a retention member configured to limit rotational movement of the toggle member beyond the conductor receiving position.

30. The terminal block of claim 28 wherein the hinge member has a bearing contact surface of at least about 90 degrees.

31. The terminal block of claim 28 wherein the environmental sealant comprises a silicone gel.

32. The terminal block of claim 28 wherein the body cavity with the connectors mounted in the base is devoid of openings up to at least an environmental sealant material fill level.

33. The terminal block of claim 28 wherein the base defines a plurality of body cavities with respective connectors extending therein and wherein the toggle member comprises a plurality of toggle members positioned adjacent respective ones of the body cavities.

34. The terminal block of claim 33 wherein ones of the connectors comprise an insulation displacing connector on a first end thereof at least partly in the body cavity and a second connection region on an opposite end thereof extending from the base.

35. A cross-connect assembly comprising a plurality of the terminal blocks of claim 34 coupled to a mounting member and a plurality of wires, respective ones of which are connected to ones of the second connection regions.

* * * * *